US006250022B1

(12) United States Patent
Paz et al.

(10) Patent No.: US 6,250,022 B1
(45) Date of Patent: Jun. 26, 2001

(54) EXTENDIBLE SHED

(75) Inventors: Haggai Paz, Zoran; Efi Haimhoff, Mevaseret Zion, both of (IL)

(73) Assignee: Keter Plastic Ltd., Herzliya (IL)

( * ) Notice: Subject to any disclaimer, the term of this patent is extended or adjusted under 35 U.S.C. 154(b) by 0 days.

(21) Appl. No.: 09/131,601

(22) Filed: Aug. 10, 1998

(51) Int. Cl.[7] ..... E04H 1/12

(52) U.S. Cl. ..... 52/79.5; 52/79.5; 52/262; 52/266; 52/271; 52/585.1; 312/100; 312/108; 312/263; 312/265.5

(58) Field of Search ..... 52/36.2, 36.5, 52/79.1, 79.5, 79.7, 79.8, 262, 266, 271, 284, 286, 585.1, 590.3, 591.3, 591.5, 592.2, 592.3, 592.4; 312/100, 107, 108, 109, 111, 205, 257.1, 263, 265.5

(56) References Cited

U.S. PATENT DOCUMENTS

| | | | | |
|---|---|---|---|---|
| 1,229,477 | * | 6/1917 | Kramer | 52/79.7 |
| 2,078,011 | * | 4/1937 | Neher | 52/262 X |
| 2,336,435 | * | 12/1943 | Zirinsky | 52/262 X |
| 3,500,596 | * | 3/1970 | Andersson | 52/79.7 |
| 3,566,554 | * | 3/1971 | Schaffer et al. | 52/79.5 X |
| 4,633,626 | * | 1/1987 | Freeman et al. | 52/79.5 X |
| 5,331,778 | * | 7/1994 | Mazpule et al. | 52/79.5 |
| 5,724,774 | * | 3/1998 | Rooney | 52/79.5 |
| 5,890,338 | * | 4/1999 | Rodriguez-Ferre | 52/36.2 X |
| 5,975,660 | * | 11/1999 | Tisbo et al. | 312/263 |

FOREIGN PATENT DOCUMENTS

| | | | | |
|---|---|---|---|---|
| 509590 | * | 3/1952 | (BE) | 52/79.1 |
| 2350779 | * | 4/1975 | (DE) | 52/79.7 |
| 1523458 | * | 3/1968 | (FR) | 52/79.7 |
| 2576624 | * | 8/1985 | (FR) | 52/79.1 |
| 2062044 | * | 5/1981 | (GB) | 52/79.1 |
| 2142057 | * | 1/1985 | (GB) | 52/79.1 |

OTHER PUBLICATIONS

"Flowtron SM–200 Storemore Plus Storage Shed Model 65007 Owner's Manual," Flowtron Outdoor Products, Melrose, MA, 6 pages.
The Cortland, The Winchester, The Hudson, The Wooster Storage Building, 1 page, Rubbermaid.
"The Woodhaven Storage Building, The Kent, The MurryhillL" Arrow Group Industries, Wayne, NJ, 3 pages.
"The Highboy Storage Shed," 2 pages.
"Rubbermaid Storage Sheds," Rubbermaid Incorporated, Wooster, OH, 5 pages (1997).
"Rubbermaid Storage Sheds," Rubbermaid Incorporated, Wooster, OH, 6 pages (1997).
"Rubbermaid Slide–Lid Storage Shed," Rubbermaid Incorporated, Wooster, OH, 2 pages (1997).
"High Shed Instructions," Keter, 6 pages.
"Vertical Partition Compact Shed Assembly Instructions," Keter, 6 pages.
"Garden Shed Instructions," Keter, 6 pages.

* cited by examiner

*Primary Examiner*—Laura A. Callo
(74) *Attorney, Agent, or Firm*—Darby & Darby

(57) ABSTRACT

An extendible shed which includes a first base panel having a back panel attached thereto, a first plurality of side panels attached to the back panel, a first roof panel connected to the first plurality of side panels and a front panel connected to the first plurality of side panels. The shed is extendible by removing the front panel and connecting a second plurality of side panels to the first plurality of side panels, reconnecting the front panel to the second plurality of side panels, connecting a second roof panel to the second plurality of side panels and the first roof panel and connecting a second based panel to the first base panel.

25 Claims, 23 Drawing Sheets

EXTENDIBLE SHED

FIELD OF THE INVENTION

The present invention relates to extendible plastic sheds and more particularly to frontwardly extendible sheds and roofs.

BACKGROUND OF THE INVENTION

Garden and utility sheds are a useful medium for storing garden implements and as greenhouses when their sides and roofs are made up of transparent panels. They are also useful for general leisure use and are cheap and easy to erect from pre-assembled parts. They must be strong, burglar proof and weatherproof. Aesthetic qualities are also advantageous.

At present, one drawback of such sheds is that they are difficult to extend when more space is required and indeed difficult to manufacture economically for the purpose of extendibility. The difficulties stem from the fact that fully interchangeable unitary components have thus far not been manufactured which enable a shed to be extended frontwardly (i.e by removal of the front doors and addition of extra side panels) whilst maintaining standards of weatherproofing, structural integrity and security.

Frontward extendibility requires removing the front doors and adding more side-panels and roof panels frontwards without dismantling the shed. It should be noted here that a shed which provides for only rearward extension is often inconvenient for a user as the shed has usually been positioned with its rear wall against or in front of a physical boundary. If a floor is desired it too must be fully interchangeable and conform to the same connectability, weather and security requirements.

One important feature of a shed in terms of extendibility and weatherproofing is the roof structure. In order to produce an economically worthwhile roof which lends itself to forward extendibility whilst maintaining standards of weatherproofing, structural-integrity, theft-proofing and non-extendible roof quality, it must be manufactured to interlock with existing roof panels and wall panels in a fully interchangeable fashion. Thus, a roof panel should equally be able to cover the section above the front doors, the section above the rear wall and a middle section, whilst maintaining standards of weatherproofing, structural integrity, theft-proofing and non-interchangeable roof quality. Non interchangeable roof quality usually consists of a single blow-moulded roof structure which is closed on three sides, having closed surfaces in three dimensions thus leaving no gap between the sides and the roof. This gives aesthetic and weatherproofing qualities, amongst other things, with no gap between the sides and the roof.

Further, ensuring the surface of an extendible roof is weatherproof is a difficult task as the requirement of dismantlability may affect the weatherproofing.

Further, the roof must contain protrusions at right angles to the roof surface in order to connect with the walls of the shed. The dual requirements of interlockability with adjacent roof panels which stems from the extendibility requirement and ability to lock to a wall panel coupled with the non-interchangeable roof quality requirement require a structure which is "closed on three sides" (as blow moulded non-interchangeable roof) as in a blow-moulded non-extendible roof structure. Being closed on three sides means the structure may fulfil all the above requirements whilst being manufactured as a unitary item. Hitherto, such a component has not been manufactured in a unitary fashion.

Reference is now made to FIG. 1 which shows an example of a prior art modular wooden shed, generally referenced 10, sold by the marketing chain: Castorama Diffusion S. A., Rue Du Chemin Vert, Lesquin, Cedex 120481, France. There does not currently exist a forwardly extendible shed currently manufactured, the "Castorama" shed reaching nearest to this goal.

The shed consists of side walls 12, roof sections 14 and a front wall 16, containing a door 18. It is purchased with as many extra side and roof panels 12A and 14A required for a chosen size. The "Castorama" is the modular in a limited way as not all the parts are interchangeable. It is certainly not extendible as dismantling would be required even if extension were feasible. Further, the shed would only be rearwardly extendible if extension were at all possible after it was built.

It is no surprise that the shed is manufactured from wood and this illustrates the difficulties associated with manufacturing the required roof and wall components in a unitary fashion from plastic.

Referring now to FIGS. 2A–2B there is shown an illustration of a prior art non-extendible shed with a roof displaying the qualities, referred to hereinabove, of a hitherto non-extendible roof (FIG. 2A). It can be seen that the roof 19 is of a "hat-like" construction (FIG. 2A) closed on three sides or dimensions A, B and C illustrated in FIG. 2B. Such a construction is obtained by blow-molding the plastic roof as is known in the art, so that roof 19 has the appearance of a wood panel.

There are many similar (non-extendible) sheds sold, not all having a blow molded roof, none of which are extendible. Examples of manufacturers of these include: Rubbermaid Incorporated, 1147 Akron Road, Wooster, Ohio, U.S.A; Royal Outdoor Vinyl Products and Royal Outdoor Products Inc. both members of Royal Group Technologies Ltd, 200 Hanlan Road, Woodbridge, Ontario, Canada.

Blow molding is ineffective for similar quality extendible roofs as weatherproofing and interconnectability are hard to achieve in a unitary blow-molded process-produced roof whilst maintaining weatherproofing, connectability and economic advantage.

SUMMARY OF THE INVENTION

An object of the present invention is to provide an extendible shed which overcomes the limitations and disadvantages of prior extendible sheds.

A further object of the present invention is to provide an extendible shed roof which overcomes the limitations and disadvantages of prior extendible shed roofs.

a further object of the present invention is to provide an extendible shed which may be extended from the end which contains the doors.

Yet a further object of the present invention is to provide an extendible roof, closed on three sides of equal quality to that of non-extendible roofs.

In one aspect of the present invention, there is provided a shed made of side panels, doors, back and floor panels interconnected by universal connectors, connectable to the side panels, doors and back panel.

In a further aspect of the present invention there is provided a shed whose extendible roof portions are closed on three sides to combine non-extendible roof quality with interconnectability and extendibility.

There is thus provided, in accordance with a preferred embodiment of the present invention, an extendible shed which includes a first base panel having a back panel attached thereto, a first plurality of side panels attached to the back panel, a first roof panel connected to the first plurality of side panels and a front panel connected to the first plurality of side panels. The shed is extendible by removing the front panel and connecting a second plurality of side panels to the first plurality of side panels, reconnecting the front panel to the second plurality of side panels, connecting a second roof panel to the second plurality of side panels and the first roof panel and connecting a second base panel to the first base panel.

Furthermore, in accordance with a preferred embodiment of the present invention, the shed further includes side connectors for connecting the second plurality of side panels to the first plurality of side panels.

The shed further includes back connectors for extendably connecting the back panels to one another vertically. The shed further includes hinged connectors for hingeably connecting the front panel to the side panels.

Furthermore, in accordance with a preferred embodiment of the present invention, the front panels function as doors and the hinged connectors function as handles on the front panels. The first and the second plurality of the panels are interchangeable.

Furthermore, in accordance with a preferred embodiment of the present invention, the first and the second base panels are interchangeable. The first and the second base panels are configured as an overturned tray-like structure.

Furthermore, in accordance with a preferred embodiment of the present invention, the first and the second base panels comprise a front to back locking system for connecting the first and the second base panels together.

In addition, the front to back locking system includes the front sloped edge of the tray-like structure separated from a main flat surface of the first base panel by a trough-like recess wherein a rear edge of the flat surface extends beyond the side edges of the first base panel to form a protrusion which facilitates mutual coupling of the first base panel to the second base panel by fitting the rear edge of the second base panel within the trough-like recess of the first base panel.

Furthermore, in accordance with a preferred embodiment of the present invention, the first and the second base panels and the first and the second plurality of side panels are constructed of polystyrene.

Furthermore, in accordance with a preferred embodiment of the present invention, each of the first and the second plurality of side panels includes a rectangular sheet having a front edge, a back edge, a top end and a bottom end wherein each of the first and the second plurality of side panels includes first, second and third conduits running internally from the top end to the bottom end.

Furthermore, in accordance with a preferred embodiment of the present invention, the first conduit runs adjacent to the back edge, the second conduit runs in a central position between the front edge and the back edge, the front edge being formed of a substantially semi-circular trough-like surface, and the third conduit runs adjacent to the front edge and wherein the back edge has a square section rib protruding the length of the back edge in a central position of the back edge;

Furthermore, in accordance with a preferred embodiment of the present invention, the back panel includes side edges formed of hollow members wherein each of the hollow members contains a square-shaped groove in the center of the hollow member which is distal from a rear edge of the back panel and runs from a top edge to a bottom edge of the back panel and wherein the back panel contains a plurality of conduits internally running from the top edge to the bottom edge of the back panel and wherein two of the plurality of conduits are situated slightly inboard of the hollow members and one of the plurality of conduits is situated in a central position between the hollow members and wherein the back panel contains apertures on a front edge of the back panel proximal to side edges of the back panel central between side edges of the back panel wherein the apertures are a central circular section from which radiates two vertical wings.

Furthermore, in accordance with a preferred embodiment of the present invention, the back panel includes a plurality of shelves having protrusions having a circular disc on the end of a member attached to the rear surface of the plurality of shelves, in equivalent position to the apertures, the plurality of shelves being inserted into the central circular section of the aperture and lockably slid downwards so that a rear surface of circular disc articulates with an internal surface of the back panel behind the apertures.

Furthermore, in accordance with a preferred embodiment of the present invention, side connector has a top edge and a bottom edge, the side connector includes a member having protrusions along its length, the protrusions being hollow and conduit-like and protruding above the top edge and beneath the bottom edge of the side connector and wherein a first protrusion is situated at a back edge of the side connector is rectangular in section and has molded to its back edge a locking structure for connection to either one of the side connector, back connector and hinged connector and wherein a second protrusion is situated centrally in the member closer to a front edge than the back edge of the connector and wherein a third protrusion is situated at the front edge of the side connector and forms a circular socket for connection to either one of the side connector, back connector and hinged connector.

Furthermore, in accordance with a preferred embodiment of the present invention, the circular socket is a short, straight wall of material running the full height of the third protrusion joined in a circular wall of material of same height as the third protrusion and wherein a portion of the circular socket distal from a back edge of the connector is formed of a hook-like structure rounded on its outer circumference at the front end of the member and wherein the hook-like structure is of a wall thickness of a second short, straight wall at its end and wherein the first short, straight wall of material faces the second short, straight wall of material to form a slot-like opening to the circular socket.

Furthermore, in accordance with a preferred embodiment of the present invention, the locking structure is a semi-circular trough-like shaped structure raised in a lip-like fashion from the back edge of the side connector attached to a hook-like structure wherein the anterior portion of the hook-like structure forms the side of a semi-circular trough-like area and wherein at the end of the anterior portion of the hook-like structure hook-like structure is formed of a straight portion parallel to the back edge of the side connector and wherein the straight portion is straight and level and runs from a back face of the member in the direction of a front face of the member and wherein the straight portion terminates in a circular disc-like structure of equal height to the hook-like structure and wherein disc like structure is a thin disc of large circumference forming the center of the disc-like structure together with an upper disc and a lower disc, both of smaller circumference, above and below the thin disc.

Furthermore, in accordance with a preferred embodiment of the present invention, the back connector includes a member having corners and protrusions along its length which are hollow and conduit-like and protrude above a top edge and below a bottom edge of the back connector and wherein a first pair of protrusions are situated on the corners of the back panel connector and protrude forward of the width of the member and wherein a second pair of protrusions are situated at edges of back panel connector inboard of the corners and a third protrusion is situated at the center of the back panel connector and wherein the first pair of protrusions have attached to their front face a locking structure.

Furthermore, in accordance with a preferred embodiment of the present invention, the locking structure is molded in the center of a front face of each of the first pair of protrusions and wherein the locking structure is a semi-circular trough-like shaped structure raised in a lip-like fashion from the front face of the first pair of protrusions connected to a hook-like structure and wherein an anterior portion of the hook-like structure forms the side of a semi-circular trough-like area and wherein at the end of an anterior portion of the hook-like structure the hook-like structure is formed of a straight portion parallel to the front face and wherein the straight portion is straight and level and runs from inner edges of the first protrusions towards outer edges of the first protrusions and wherein the straight portion terminates in a circular disc-like structure of equal height to trough-like shaped structure wherein circular disc-like structure is aligned centrally between the inner and the outer edges of the protrusions.

Furthermore, in accordance with a preferred embodiment of the present invention, each of the first and the second roof panels is tray-like, closed on three sides having a solid surface on each of three axes and protrusions for slideably locking the first and the second roof panels to the first and the second side panels and further includes a roof locking and weatherproofing mechanism and wherein the protrusions are situated on each of two side edges of the first and the second roof panels protruding downwards and wherein a first protrusion is at a back edge of the first and the second roof panels, a second protrusion is central but towards the back edge of the first and the second roof panels and a third protrusion is at a front edge of the first and the second roof panels and wherein the first and the second roof panels has a semi-circular boss on each of two side edges of the first and the second roof panels forward of the third protrusion at a front edge of the first and the second roof panels for hingeably connecting the front panels to the first and the second roof panels and wherein the first and the second roof panels are ridged.

Furthermore, in accordance with a preferred embodiment of the present invention, the roof locking and weatherproofing mechanism includes a lip-like structure on the front edge of the first and the second roof panels which consists of a front surface which tapers downwards and inwards to an inward step which then becomes a gable and wherein the back edge of the first and the second roof panels has an orifice-like receptor section with a wall of material which tapers and steps downwards and outwards in an equal and opposite way to the front surface for lockably and reciprocally receiving lip-like structure of front end of a more rearward the first and the second roof panels.

Furthermore, in accordance with a preferred embodiment of the present invention, the receptor section has a flexible upper lip and a flexible lower lip which seal a joint duly formed by the second roof panel and the first roof panel wherein the lower lip and the upper lip form clip-like structures to seal the join.

Furthermore, in accordance with a preferred embodiment of the present invention, the front panel generally flat having a top end and a bottom end and wherein the front panel includes a substantially semi-circular conduit at a side edge of the front panel and a first conduit inward of the semi-circular conduit and wherein the semi-circular conduit hingeably connects with the first and the second roof panels and with the first and the second base panel and wherein the front panel has a second conduit distal of the first conduit at a far edge of the front panel and wherein first conduit protrudes backwardly further than the semi-circular conduit to rest against inner wall of the side panel to stop movement of the front panel and wherein the semi-circular conduit begins with a short wall parallel to a front surface of the front panel the short wall articulating with a side edge of the side panel and wherein the semi-circular circular conduit continues with a circular wall which curves towards the front surface of the front panel to eventually straighten and merge with the front surface wherein backward facing portion of semi-circular conduit articulates with a forward curved surface of the side panel and wherein the front panel connects vertically via the first and second conduits with the hinged connector and a second front panel.

Furthermore, in accordance with a preferred embodiment of the present invention, each of the hinge connectors has a first and second protrusion at a front end protruding above and below an upper and a lower surface of the door connector and a hinge assembly at a rear end containing a hinge mechanism and wherein the hinge assembly has a thin-walled squaroid hollow protrusion and a thin-walled semi-circular protrusion with a gap in between protruding above and below a collar surrounding a hinge mechanism and wherein the first and second protrusions and the semi-circular protrusion slideably fit into the conduits in the front panels for vertical door extendibility wherein straight internally facing walls of the thin walled squaroid protrusion and the thin-walled semi-circular protrusion engage a wall between squaroid and semi circular conduits in the front panel.

Furthermore, in accordance with a preferred embodiment of the present invention, the hinge mechanism includes an upper clip and a lower clip, projecting rearwards from a rear edge of front face of the collar and wherein each of the upper clip and lower clips have two calipers, each of the calipers forming a slot with a semi-circular apex and wherein the calipers are a vertical distance apart so as to engage an upper and a lower surface of a thin disc of hook-like structure of the side connector and wherein the calipers springably engage and grip an upper disc and a lower disc respectively in a hinge-like fashion to facilitate rotation of the clips around the upper and lower discs and wherein a squaroid aperture in rearmost wall of the collar facilitates access of the hook-like structure of the side connector to engage the clips and wherein the rear end of the door connector and the collar are rounded so that when the front panel is opened the collar articulates with a trough like front edge of the side panel and wherein the general trough-like shape of the side connector above and below the semi-circular trough-like shaped structure facilitates congruent movement of the outer surface of the semi-circular protrusion when the front panel is opened.

In addition, there is provided, in accordance with a preferred embodiment of the present invention, a connector for connecting a plurality of panels together, the connector having a top edge and a bottom edge, the connector includes a member having protrusions along its length, the protrusions being hollow and conduit-like and protruding above the top edge and beneath the bottom edge of the connector and wherein a first protrusion situated at a back edge of the connector is rectangular in section and has molded to its back edge a locking structure for connection to a second connector and wherein a second protrusion is situated centrally in the member closer to a front edge than the back edge of the connector and wherein a third protrusion is situated at the front edge of the connector and forms a circular socket for connection to a second connector.

Finally, there is provided, in accordance with a preferred embodiment of the present invention, a roof panel which includes a tray-like member closed on three sides having a solid surface on each of three axes and protrusions for slideably locking the roof panel to a side panel and further includes a roof locking and weatherproofing mechanism and wherein the protrusions are situated on each of two side edges of the roof panel protruding downwards and wherein a first protrusion is at a back edge of the roof panel, a second protrusion is central but towards the back edge of the roof panel and a third protrusion is at a front edge of the roof panel and wherein the roof panel has a semi-circular boss on each of two side edges of the roof panel forward of the third protrusion at a front edge of the panel for hingeably connecting a second panel to the roof panel and wherein the roof panel is ridged.

BRIEF DESCRIPTION OF THE DRAWINGS

The present invention will be understood and appreciated more fully from the following detailed description taken in conjunction with the appended drawings in which.

DETAILED DESCRIPTION OF THE PRESENT INVENTION

Figure 1:
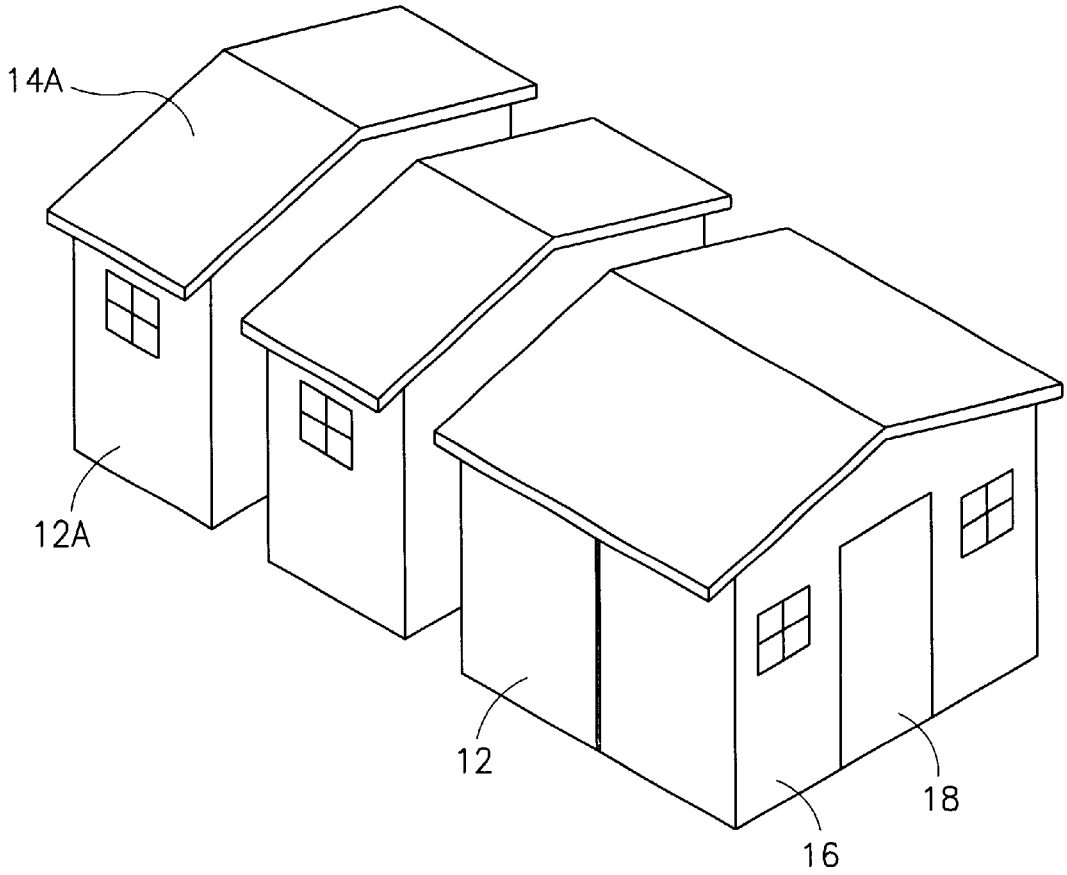
FIG.1 PRIOR ART
FIG. 1 is an isometric illustration of an extendible shed constructed in accordance with the prior art.
Figure 2A:
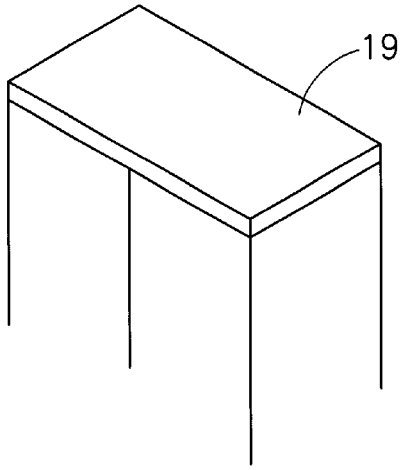
FIG.2A PRIOR ART
FIG. 2A is a schematic illustration of a prior art non-extendible shed with a typical roof.
Figure 2B:
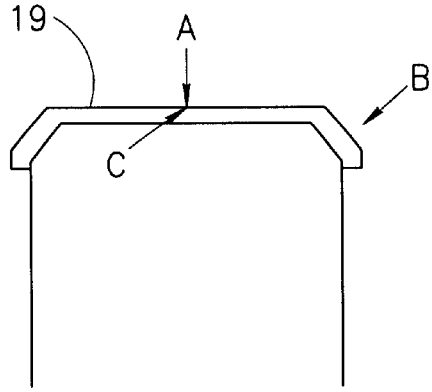
FIG.2B PRIOR ART
FIG. 2B is a sectional view schematic diagram illustration of a typical prior art blow-molded non-extendible roof.
Figure 3:
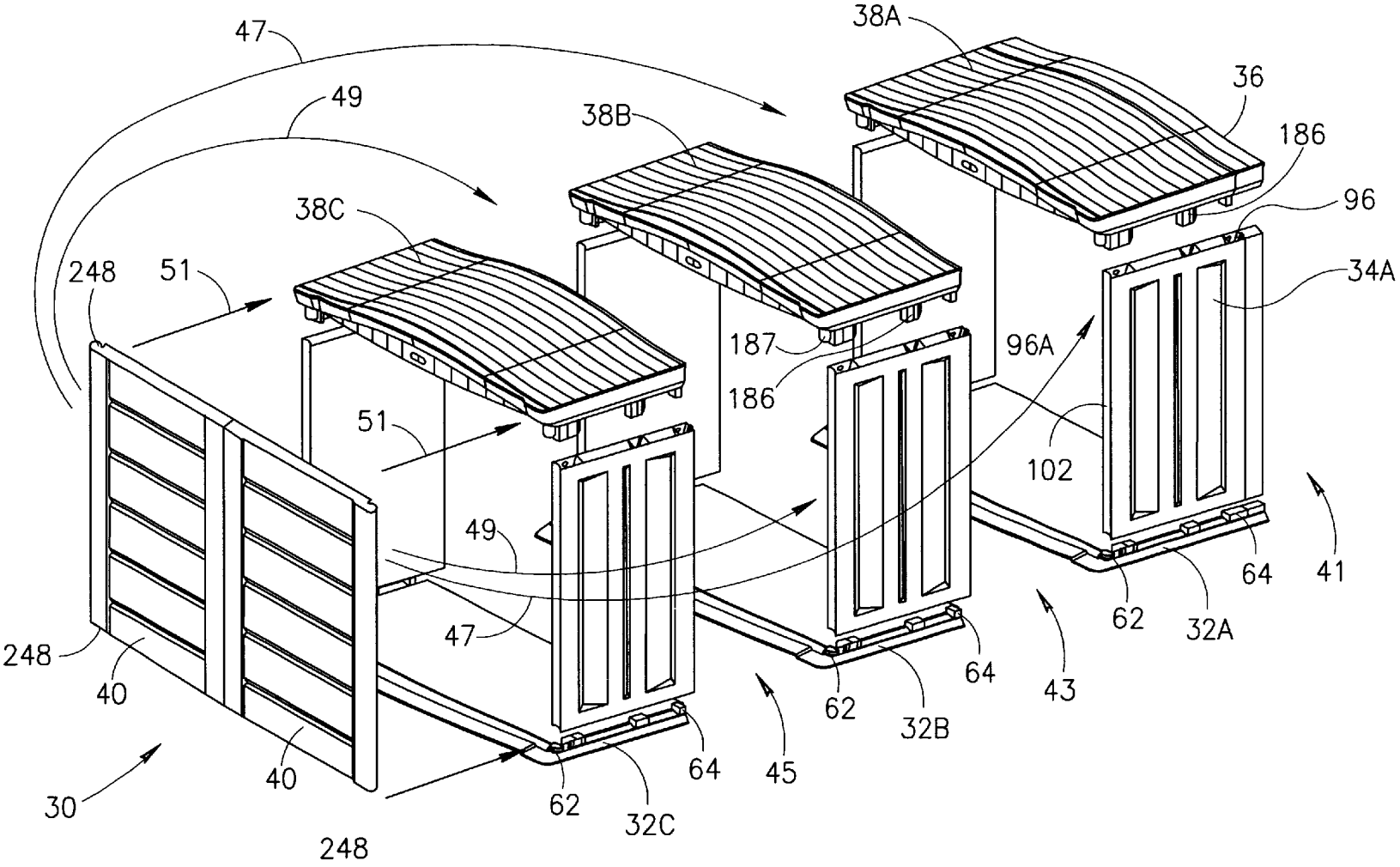
FIG. 3 is an isometric exploded view illustration of an extendible shed according to a preferred embodiment of the present invention.

Reference is now made to FIG. 3 which shows the extendible shed of the present invention in various stages of assembly.

FIG. 3 which is now referred to shows an isometric exploded view of the extendible shed, generally referenced 30, according to a preferred embodiment of the present invention. Shed 30 is made up of base panels 32, side panels 34, back panels 36 (not shown), roof elements 38 and door panels 40.

FIG. 3 shows the mode of extension of shed 30 beginning with an initial unit of shed 30, generally referenced 41, and made up of interconnected components. To constitute initial unit of shed 41, conduits 96 in side panels 34A fit into protrusions 64 in base panel 32A and also into protrusions 186 in roof panel 38A in a manner that locks as described further hereinbelow. Base panel 32A is slightly modified compared to base panels 32B and 32C in order to accommodate back panel 36.

A locked, rigid initial walled and roofed unit 41 of shed 30 is formed. Doors 40 fit hingeably onto the front of unit 41 via bosses 62 in base 32A and bosses 187 in roof element 38A which fit into substantially semi-circular conduits 248 in door panel 40 as described further hereinbelow. Doors 40 are fixed adjacent to side panels 34A in a position shown by arrows 47.

To extend the unit 41 frontawardly, doors 40 are removed and a second unit of the shed, generally referenced 43 and made up of base panels 32B, side panels 34B and roof element 38B is added by a procedure which obviates the necessity to dismantle shed 30 to extend it. The procedure which is described further hereinbelow involves lifting a roof panel 38 at an angle in order to insert extra side panels 34 and to insert an extra roof panel 38 ahead of the old ones and then snapping the roof element back to lock all components.

Bosses 187 in roof element 38A, formerly utilized to hingeably attach doors 40, fit into conduits 96A to form a locked structure (not shown). Front end 197 of roof element 38A is formed of a lip-like structure 199 for lockably entering an orifice-like receptor section 208 of roof element 38B. Unit 43 is similarly constructed to unit 41, except that base panel 32B is not modified to accommodate back panel 36.

Base panel 32B slides into front of base panel 32A and is secured by screws as is described further hereinbelow. Doors 40 are then mounted adjacent to side panels 32B utilizing the insertion of bosses 187 in conduits 248 in a similar manner to their attachment as described hereinabove, as indicated by arrows 49.

A third extension may be similarly made utilizing base panel 32C, side panels 34C and roof panel 38C which make up unit 45. Doors 40 are removed from a position adjacent to side panels 34B and after unit 45 is married with unit 34 door 40 are replaced adjacent to side panels 34C in accordance with arrows 51. Indeed, any number of extensions may be made, thus shed 30 is forwardly extendible to a length depending on a user's choice.

The fact that side panels 32 have a semi-circular trough-like surface 102 (FIGS. 4, 5B referred to hereinbelow) on their front edge 100 means that any side panel 32 may be the frontmost side panel 32, as trough-like surface 102 allows semi-circular conduits 248 on doors 40 to rotate when doors 40 are opened. This feature will be described further hereinbelow.

Furthermore, side panels 34 have a square section rib 99 (FIG. 4, referred to hereinbelow) on their rear edge which marries with backpanel 36 and also completes a weather seal by protruding into trough-like surface 102 of a preceding side panel 32.

Similarly, roof elements 38 are interchangeable each having an orifice-like receptor section 208 (FIG. 8, hereinbelow) at their rear and a lip-like structure 199 (see also FIG. 8) for lockably entering orifice-like receptor section of a roof element 38 ahead of it.

Thus, every side panel 32 and roof element 38 is adapted to the extendibility function and indeed modularity also as each side panel 32 and roof element 38 may be situated in any position where a side panel 32 or roof element 38, respectively is required.

A shed featuring both modularity and extendibility keeps production and consumer costs down and gives a consumer the choice to extend his shed 30 later.

The actual mode of facilitating extension is not to assemble extension units 41,43, 45 and others at first but to follow a specific sequence of events which allow extendibility by preventing the necessity for dismantling shed 30 or the collapse of shed 30 prior to its extension as mentioned hereinabove.

The sequence is as follows: Remove front doors 40 by releasing top locking snaps, add front base panel 32B (base extension), add two side panels 34 on each side. Add a new roof element 38 by pressing it into old roof element 38 towards back panel 36 and then lowering it towards the base 32, allowing the bosses 186 on the top to enter the side panels conduits 96. Press the back roof element 38 together with the front roof element 38 until bosses 186 are in their final position. Push the front roof element 38 about 5 degrees up by releasing locking snaps on front bosses 186, leave the front roof element 38 in this position until positioning of doors 40 in their new position has been accomplished. Finally, lock front doors 40 hingeably by lowering front roof element 38 to its final position with front bosses 187 inserted in semi-circular conduits 248 in door panels 40.

Figure 4:
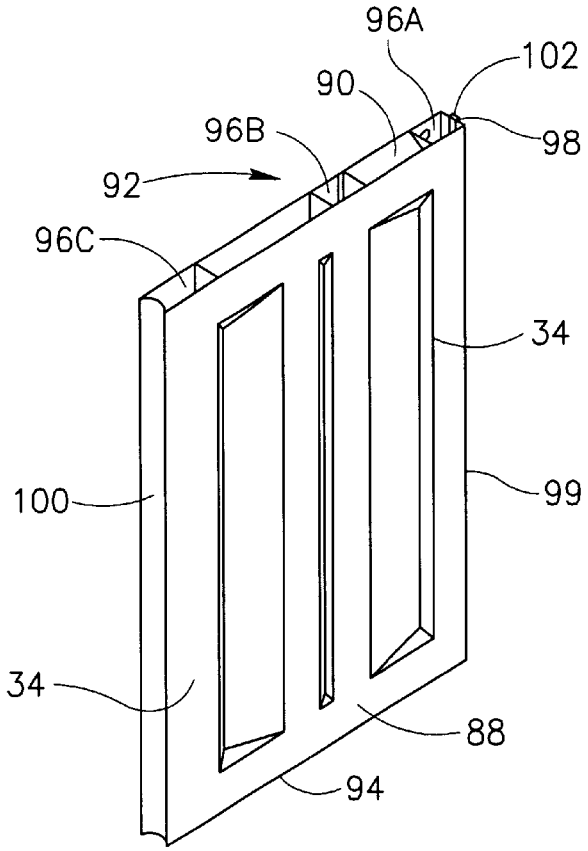
FIG. 4 is an isometric illustration of a side panel section of an extendible shed according to a preferred embodiment of the present invention.

Reference is now made to FIG. 4 in which there is shown an isometric illustration of a side panel section 34 of an extendible shed according to a preferred embodiment of the present invention. Side panel 34 is injection molded from polypropylene as a one piece construction. Side panel 34 has a front edge 88 and a back edge 90, a top end 92 and a bottom edge 94. Side panel 34 is solid apart from three rectangular shaped conduits running internally from top end 92 of side panel 34 to bottom end 94 of side panel 34. Conduit 96A runs adjacent to back edge 98 of side panel 34, conduit 96B runs at a central position of side panel 34 and conduit 96C runs adjacent to a forward edge 100 of side panel 34. Additionally, back edge 98 has a square section rib 99 protruding the length of back edge 98 in the center of back edge 98 and forward edge 100 is formed of a substantially semi-circular trough-like surface 102.

Figure 5A:
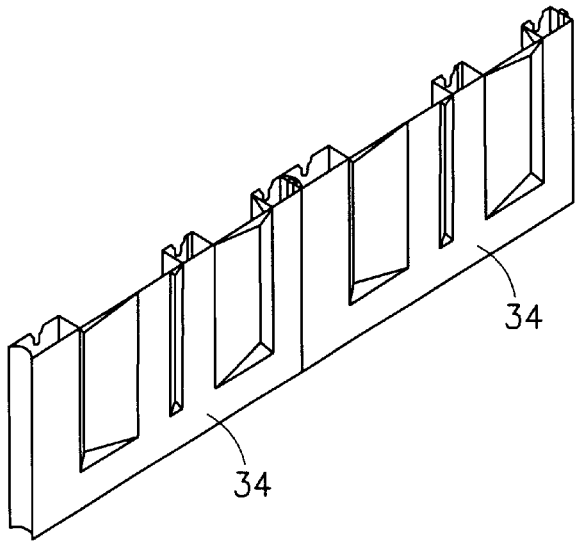
FIGS. 5A–5B are isometric illustrations of the connections between two side-walls according to a preferred embodiment of the present invention.
Figure 5B:
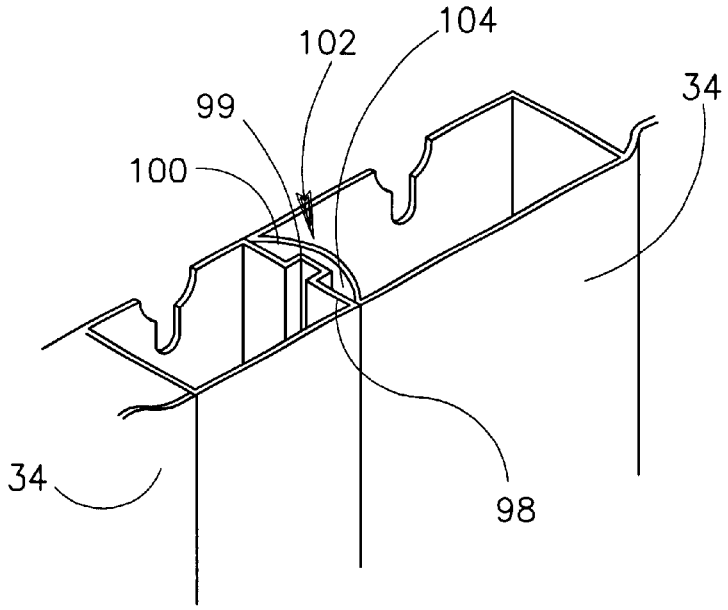

Adjacent side panels 34 meet at their respective back and forward edges 98 and 100. FIG. 5A which is now referred to shows two adjacent side panels 34 and FIG. 5B which is now referred to shows the interface of forward edge 100 of side panel 34 with back edge 98 of side panel 34. As can be seen from FIGS. 5A and 5B the radius of substantially semi-circular trough-like surface 102 of forward edge 100 is curved so that it accommodates within a substantially concave area 104 formed by substantially semi-circular trough-like surface 102 the depth of square section rib 99. The corners of back edge 98 and forward edge 100 of adjacent side panels 34 touch as shown in FIGS. 5A and 5B.

As mentioned hereinabove, side panel 34 is adapted for extendibility and modularity as it is fully interchangeable with any other side panel 34. Further, forward edge 100 of side panel 34 is shaped as substantially semi-circular trough-like surface 102 to facilitate addition of door panels 40 at its front edge 100 facilitating forward extendibility. Forward extendibility is facilitated because door panels 40 can be removed and replaced with additional side panels 34 which in turn can accommodate doors 40. Square section rib 99 both marries with a reciprocal square-shaped groove 70 in back panel 36 and rests within substantially semi-circular trough-like surface to form a weather seal. Thus, side panels are specifically adapted to forward extendibility and, indeed, modularity which gives economic as well as functional advantages.

Figure 6A:
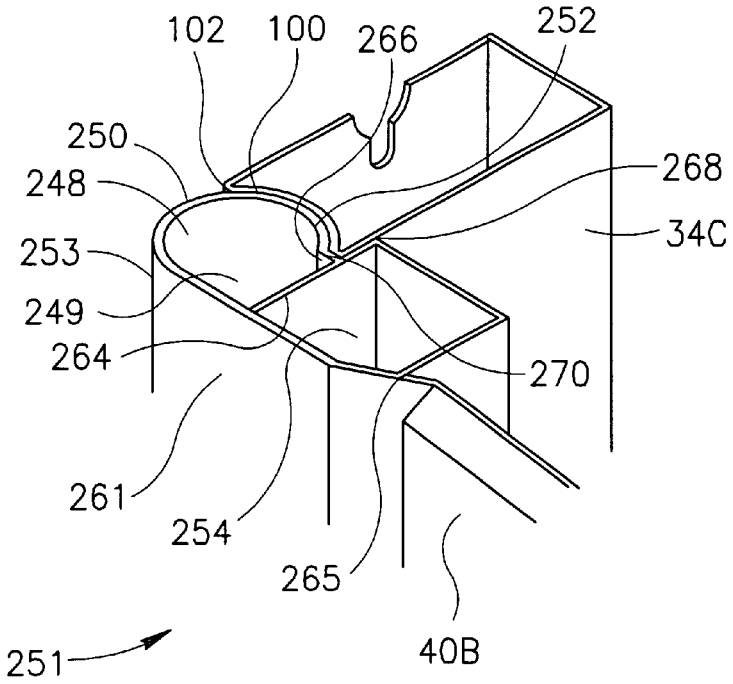
FIG. 6A is an isometric view of a door panel showing the mode of articulation of the rounded edge of the door with the wall to form a hinge.
Figure 6B:
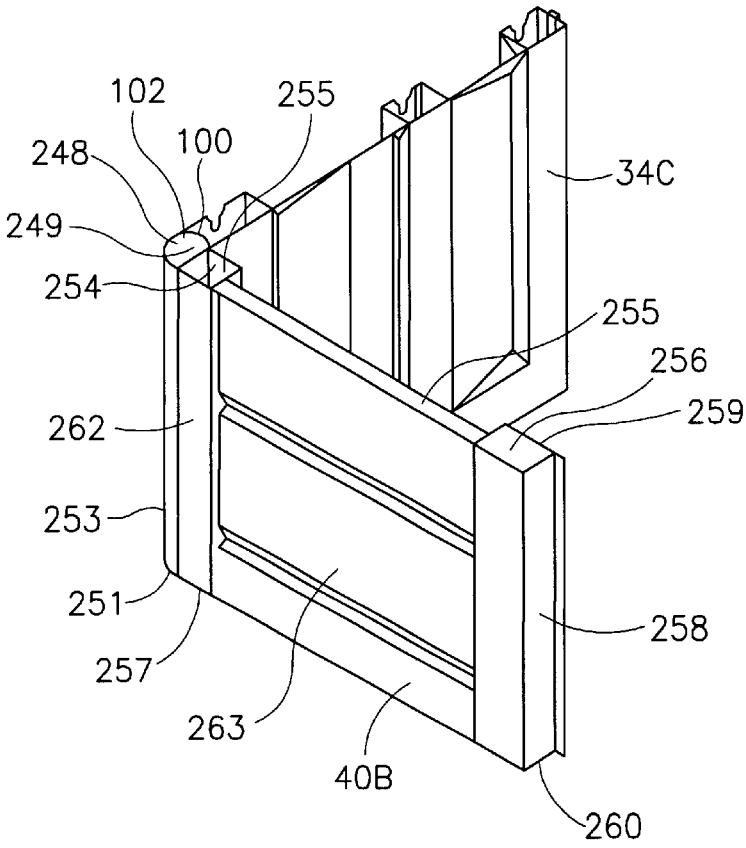
FIG. 6B is an isometric view of a door panel showing how it articulates with a side wall.
Figure 6C:
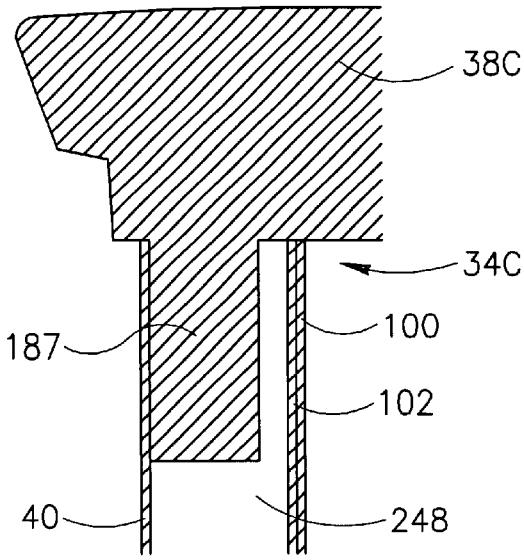
FIG. 6C is a side elevation view of a roof section and door showing the mode of articulation of the hinges with the doors.

FIG. 6A which is now referred to shows an isometric view of top of side panel 34C and top of upper door panel 40B. FIG. 6B which is now referred to shows an isometric view of side panel 34C and door panel 40B. FIG. 6C which is now also referred to shows a side view of roof element 38C with boss 187 protruding into conduit 248 to form a hinge.

Door panels 40 may, in a preferred embodiment, be injection molded from polystyrene as a one piece construction. Door panels 40 have a substantially semi-circular conduit 248 at a side edge 253 which has a top end 249 and a bottom end 251 and squaroid conduits 254 adjacent to substantially semi-circular conduits 248 which have a top edge 255 and a bottom edge 257 (FIG. 6B). Bosses 187 of front roof panel 38C (FIG. 3) is inserted into conduit 248 to form a hinge and boss 62 of front base panel 32C is inserted into bottom edge 257 of conduit 248 (FIG. 6B). Door panel 40 also has a squaroid conduit 256 at a middle edge 258 of door panel 40, which has a top end 259 and a bottom end 260. Squaroid conduits 254 and substantially semi-circular conduits 248 are enclosed by a front face 261 which is straight and tapers inwards in a diagonal fashion to a front inwardmost corner 265 of squaroid conduit 254 which is rendered flat thereby. The area between the end of front face 261 and squaroid conduit 256 is a flat door panel surface 263 (FIG. 6B).

Substantially semi-circular conduit 248 has a straight wall 264 extending rearwards which is shared with squaroid conduit 254 but only extends a proportion of the length of squaroid conduit 254 towards the rear. Continuing around the perimeter of squaroid conduit 248 there is a short wall 266 perpendicular to wall 264 followed by a circular wall 250 extending round until circular wall 250 straightens and becomes front face 261. The rearward facing portion of circular wall 250 is adjacent to forward edge 100 of side panel 34 so that rearward facing portion of circular wall 250 is adjacent to and congruent with trough-like surface 102 of side panel 34. When door panel 40 is in the closed position, the portion of wall 264 which exceeds the length of substantially semi-circular conduit 248 and forms the rearmost part of squaroid conduit 254 is in contact with a front inward facing edge 268 of side panel 34 which stops any further inward movement of door 40. Also, the rearward facing portion of short wall 266 is in contact with inner frontmost edge 270 of forward edge 100 of side panel 34 forming a pivot point for the articulation of side panel 34 with door panel 40. As door panel 40 is opened, more of circular wall 250 towards front face 261 comes into contact with trough-like surface 102 forming a hinge-like movement.

Figure 7A:
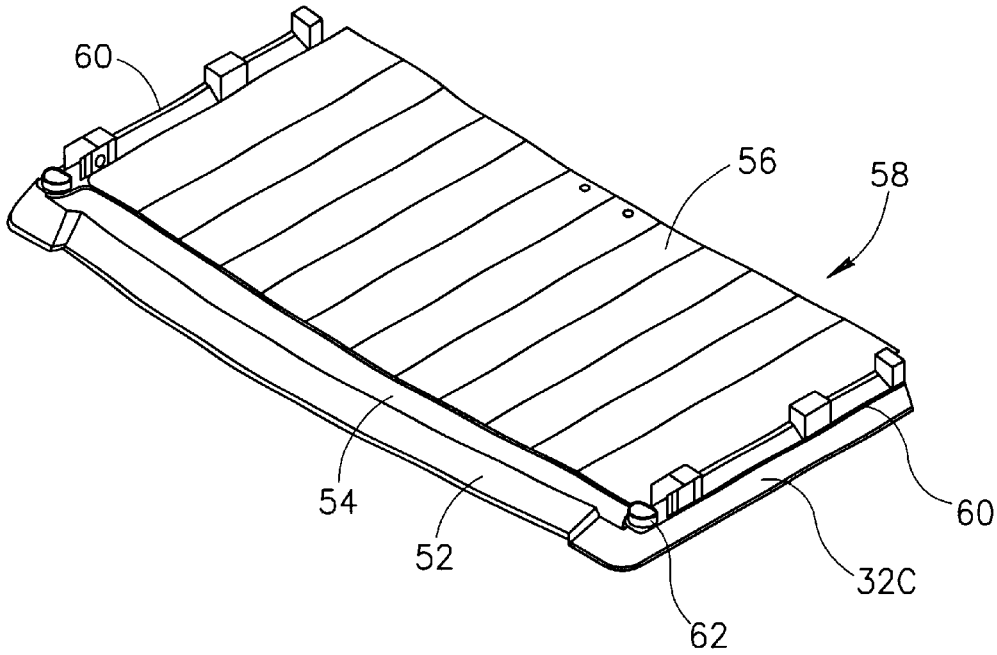
FIG. 7A is an isometric illustration of a single base section of an extendible shed according to a preferred embodiment of the present invention.
Figure 7B:
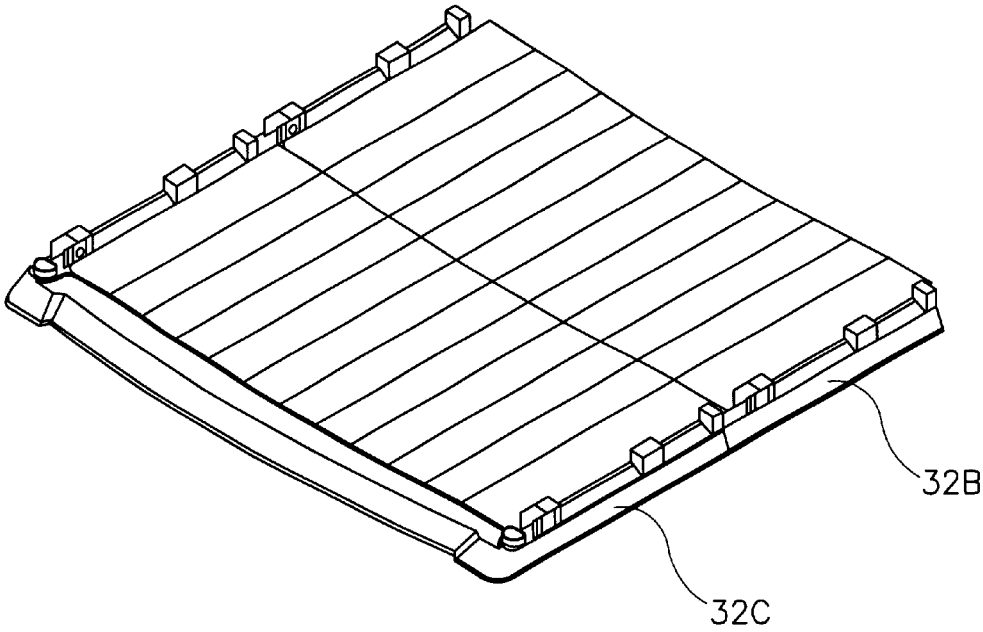
FIG. 7B is an isometric illustration of two base sections of an extendible shed joined together according to a preferred embodiment of the present invention.
Figure 7C:
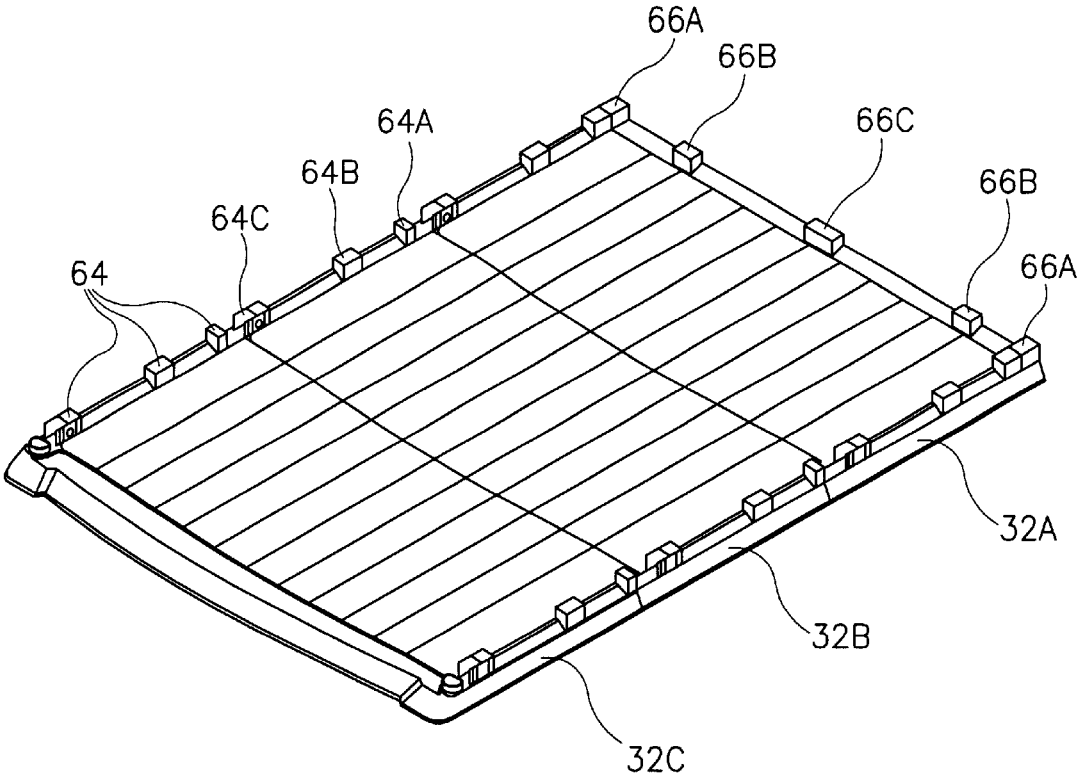
FIG. 7C is an isometric illustration of three base sections of an extendible shed joined together according to a preferred embodiment of the present invention.

Reference is now made to FIGS. 7A, 7B, 7C and 7D which show base panels 32A–C. Elements of this embodiment of the invention which are similar to elements which have been previously described with respect to the preferred embodiment hereinabove, are similarly designated and will not be further described. Base panel 32C is identical to base panel 32B. Thus, all the forward base panels are completely interchangeable for the purposes of extendibility. This adds to the cost-effectiveness of extendibility and manufacturing costs are reduced due to the reduced number of components. This is illustrated in FIGS. 7B and 7C now referred to.

Figure 7D:
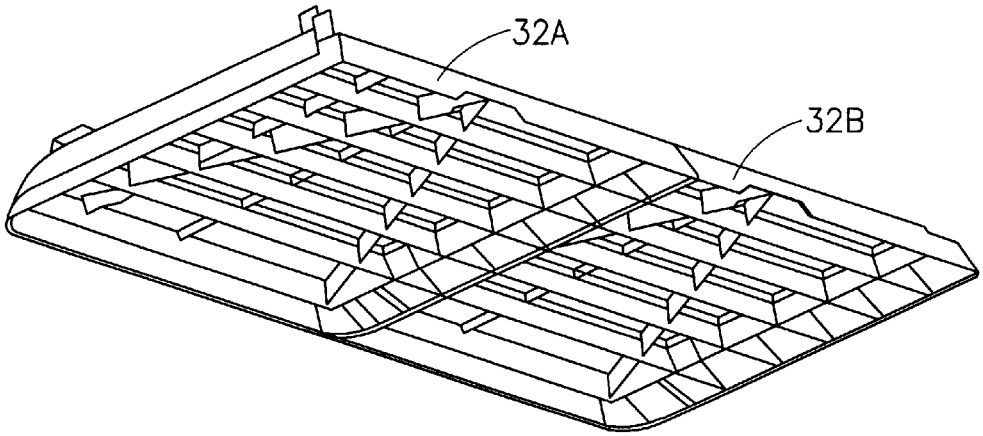
FIG. 7D is an isometric illustration of the base section of FIG. 7A of an extendible shed according to a preferred embodiment of the present invention.

FIG. 7A which shows a forward base panel 32C is now referred to. Base panel 32C consists of a front sloped edge 52 and a trough-like recess 54 which separates front sloped edge 52 from the main surface 56 of base panel 32C. Main surface 56 of base panel 32C is ribbed for ease of traction. Rear edge 58 of main surface 56 of base panel 32C extends beyond side edges 60 of base panel 32 to produce a protrusion which aids mutual coupling of base panels 32 (for example panel 32A to 32B). This is also shown in FIG. 7D now referred to.

Edge 58 of panel 32B fits within trough-like recess 54 of panel 32C. Base panel 32 is dish-shaped so that when placed on the ground, there is a hollow void underneath, closed on three sides 52 and 60 as shown on FIG. 7D which is a view from beneath of base panels 32A and 32B married together.

Base panel 32 (FIG. 7A) contains a number of features which aid the feature of extendibility, namely boss 62 which is of a semi-circular shape to articulate with door 40 (where necessary) and to accommodate side-panel 34. This allows the doors to be affixed to any base panel 32 which happens to be at the front, thus facilitating extendibility and cost saving through commonality of parts. Further, base panel 32 contains rectangular protrusions 64 along its side edges which allow side-panels 34 to universally be affixed over it in a male-female type arrangement. Protrusion 64A is closest to edge 58 of base panel 32B, protrusion 64B is in the center and protrusion 64C is furthest from edge 58.

Referring now to FIG. 7C there are shown three base panels 32, 32A being a back base panel. It can be seen that back panel 32A is not universal and is designed for back use only, that is, as the rearmost panel. Back base panel 32A contains protrusions or pegs 66 to enable back panel 36 to universally be affixed over it in a male-female type arrangement. Protrusions 66A are on the back corner of back base panel 32A, protrusions 66B are at the edges of back base panel 32A adjacent to the rear corners and protrusion 66C is at the center of the rear edge of back base panel 32A. FIG. 7B also shows the coupling of base panels 32B and 32C.

Figure 8A:
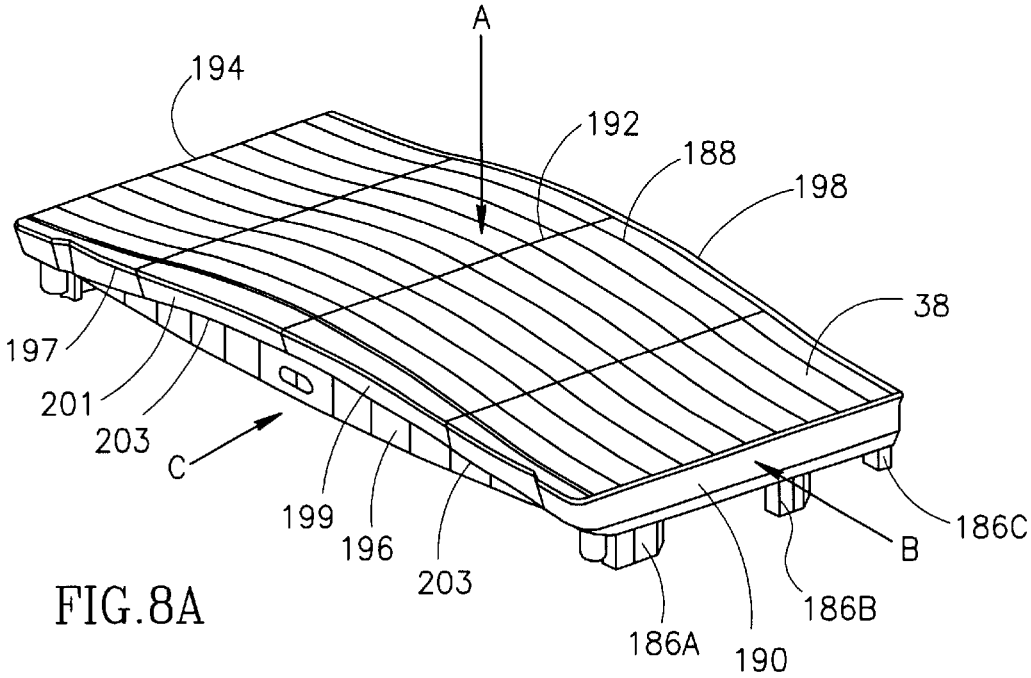
FIG. 8A is an isometric view from above of an extendible roof section according to a preferred embodiment of the present invention.

FIGS. 8A–H which show various views of a roof element are now referred to. FIG. 8A which is now referred to shows an isometric view of a roof element 38 (FIG. 3) of shed 30. Roof element 38 may, in a preferred embodiment, be injection molded from polystyrene as a one piece construction. Roof element 38 appears closed on three sides as in the traditional non-extendible roof. Being closed on three sides entails having a solid surface in directions A, B and C as shown on FIG. 8A. This three-sided closure lends itself to cost-effective unitary component extendibility as, in addition to a roof element-roof element locking mechanism 184 in one dimension (FIG. 8E) there are enabled a series of protrusions 186A, 186B and 186C. Protrusion 186A is closest to a front end 197, 186B almost central but slightly towards a back edge 198 and 186C at back edge 198. Protrusions 186A, 186B and 186C slideably fit inside forward conduit 96C, central conduit 96B and rear conduit 96A of side panel 34, respectively in a male-female type arrangement (FIG. 3, FIG. 4). Roof element 38 also has two bosses 187 on each of the front corners closest to a front end 196 in equivalent positions to bosses 62 on base panel 32. Bosses 187 are of a semi-circular shape to articulate with doors 40 (where necessary) and to accommodate side-panels 34. This feature allows the doors to be affixed to any roof element 38 which happens to be at the front, thus facilitating extendibility and cost saving through commonality of parts. The blow molded (hat-shaped) roof quality requirement is also not compromised by the advantages described above.

Top roof surface 188 curves gently from a side wall 190 of roof element 38 to a centerline 192 of top roof surface 188 and then follows the same shape conversely as it curves down to a second side wall 194 of roof element 38. This shape aids drainage of water along the top roof surface 188 as the water flows from centerline 192 towards the sides of shed 30. The shape of the curve is shown in the front and back elevations of roof element 38 shown in FIG. 8C and FIG. 8D now referred to. Roof element 38 has a gable 196 at its front end 197. Front end 197 has a lip-like structure 199 which consists of a front surface 201 which tapers downwards and inwards to an inward step 203 which then becomes gable 196.

Figure 8B:
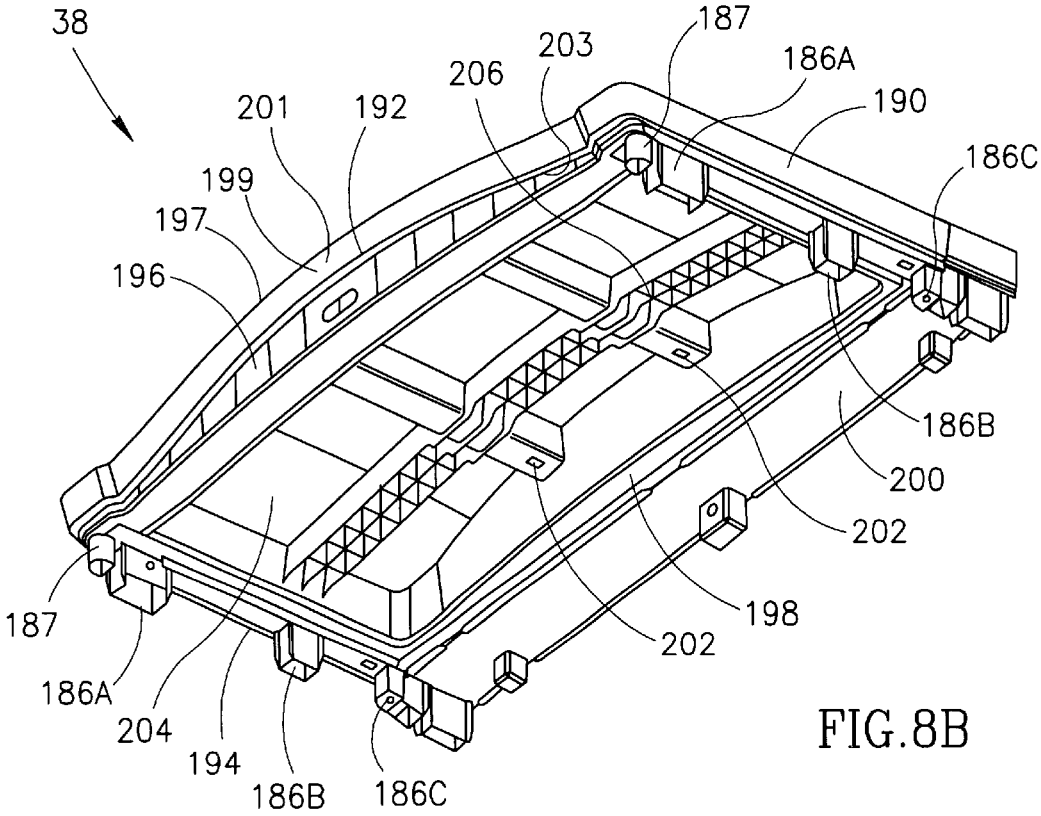
FIG. 8B is an isometric view from beneath of an extendible roof section according to a preferred embodiment of the present invention.
Figure 8C:
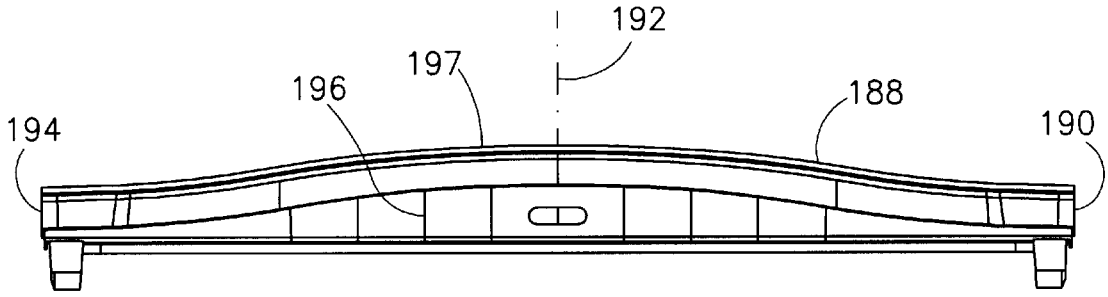
FIG. 8C is a side elevation view of an extendible roof section according to a preferred embodiment of the present invention.

FIG. 8B which is now particularly referred to is an isometric view of a roof element 38 showing the underside of a roof element 38. A back filler bar 200, which will be described in more detail hereinbelow is added for the rearmost roof element 38. As is shown by FIG. 8B, roof element 38 is vaulted or laminated with reinforcing struts 202 which run on the bottom roof surface 204 from front gable 196 to back end 198. A further strut 206 running from a side 194 to side 190 is also incorporated on bottom roof surface 204. Strut 202 is situated at the same position along sides 190 and 194 as protrusions 186B. Struts 202 and 206 lend structural support to roof element 38.

Figure 8D:
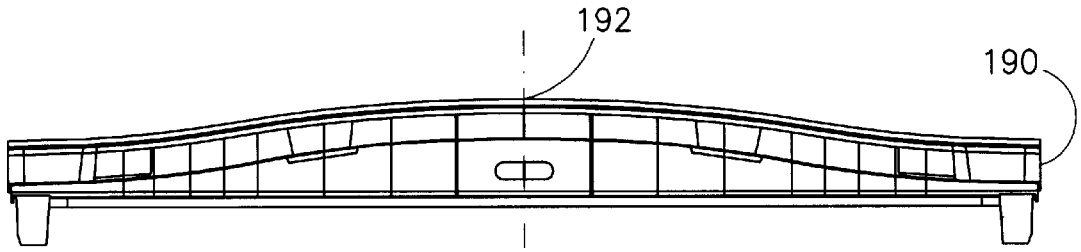
FIG. 8D is a side elevation view of an extendible roof section according to a preferred embodiment of the present invention.
Figure 8E:
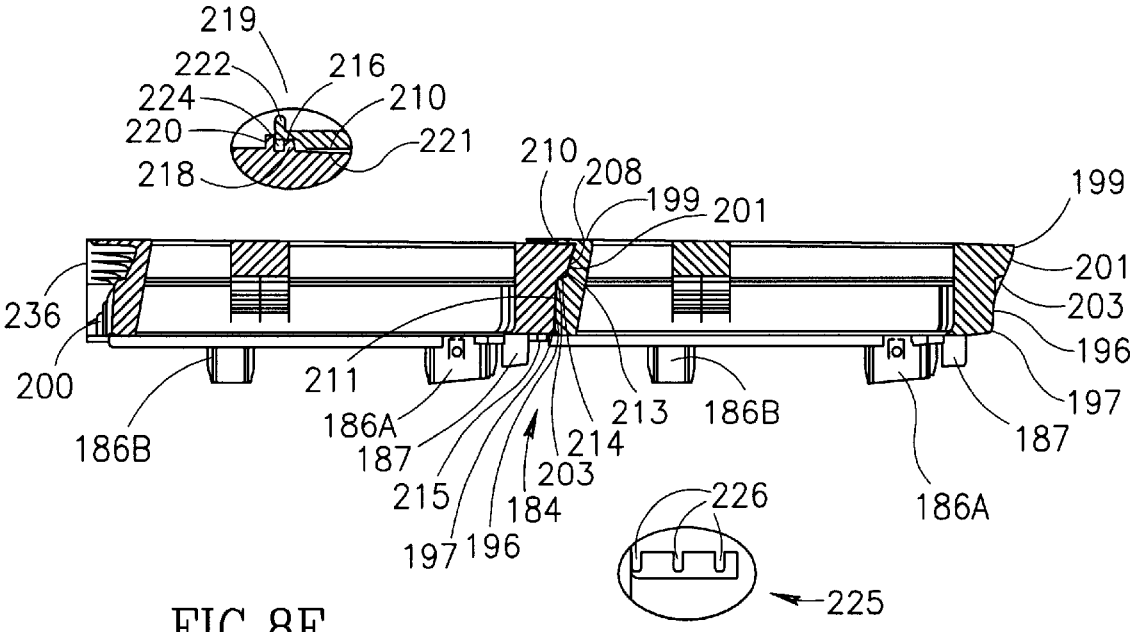
FIG. 8E is a section A—A as shown on FIG. 8D of the extendible roof section showing the male-female weatherproofed joint system and the mode of connection of two extendible roof sections.
Figure 8F:
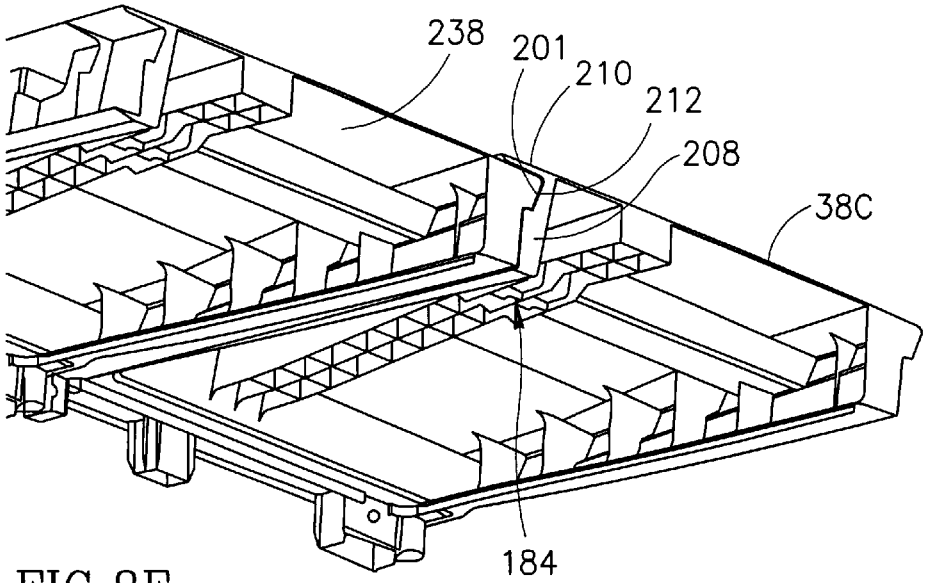
FIG. 8F is a view of the underside of two connected extendible roof sections.
Figure 8G:
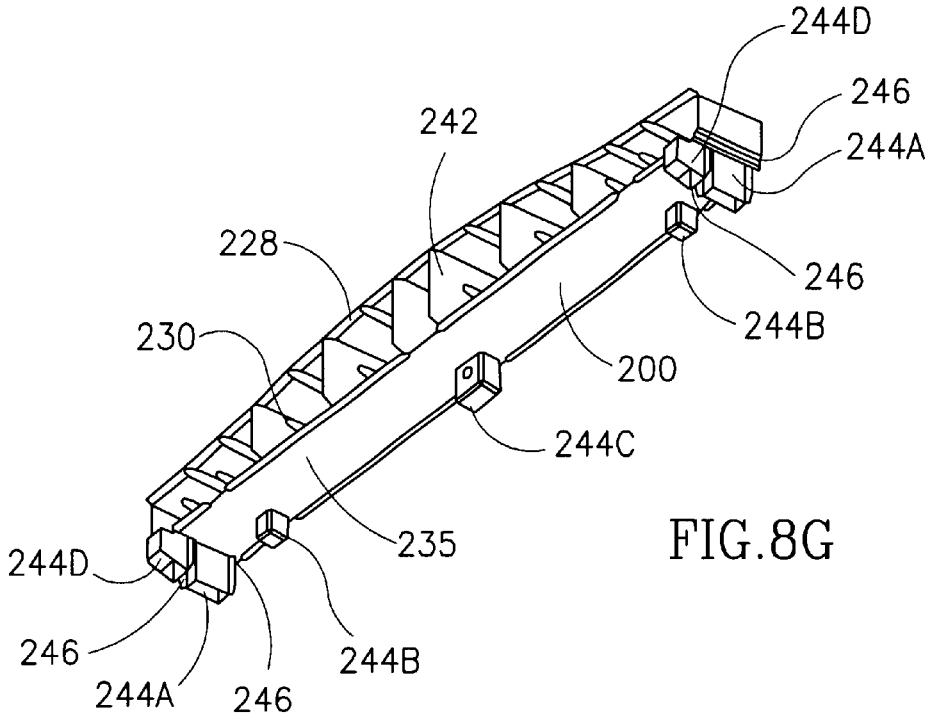
FIG. 8G is an isometric view of a back roof element according to a preferred embodiment of the present invention.
Figure 8H:
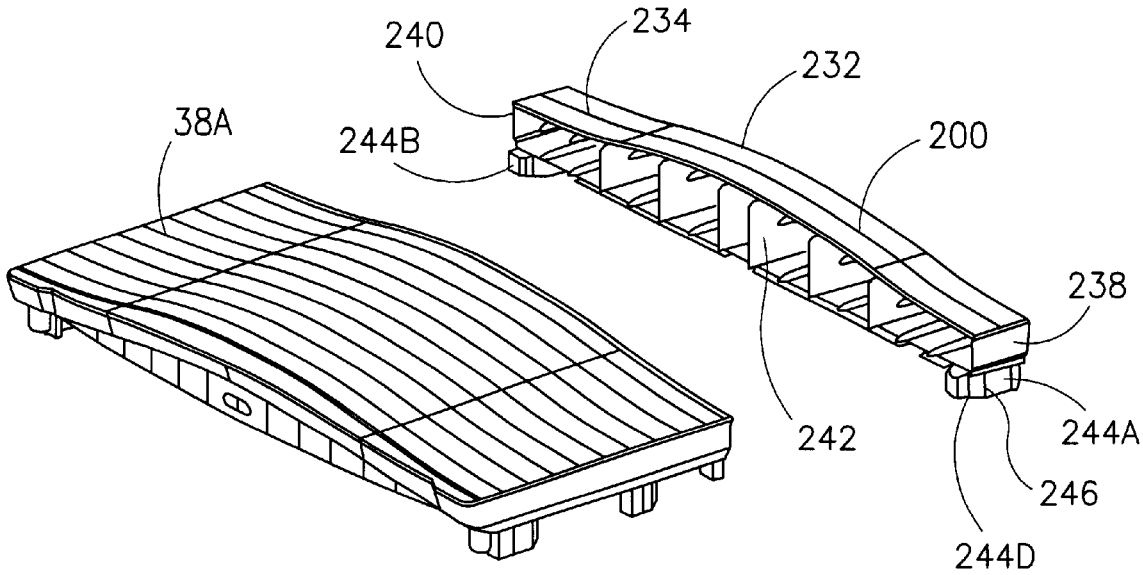
FIG. 8H is an isometric view of an extendible roof section and its attendant back roof element.

FIG. 8E which is a sectional view AA through FIG. 8D and FIG. 8F which is an isometric view of two roof panels 38 joined together are now referred to. FIG. 8E shows two roof elements joined together at joint 184. FIG. 8E also shows detail of back end 198 of roof element 38 showing an orifice-like receptor section 208 for lockably receiving lip-like structure 199 of front end 197 of roof element 38. Receptor 208 is made up of a long thin upper lip 210, constructed of a thin wall of material such that upper lip 210 is bendy. There is also a lower lip 212 constructed of a thin wall of material such that lower lip 212 is also bendy. Beneath upper lip 210 at its edge closest to front end 197 of roof element 38 is a wall of material 213 which tapers downwards and outwards in an equal and opposite way to front surface 201 of roof element 38. At the end of the taper of wall of material 213 is an outward step 214 equal and opposite to inward step 203 of front surface 201 of roof element 38. Following outward step 214 is a straight portion of material 211 culminating in lowest lip 215. When two roof elements 38 are locked together, a front surface 201 of a roof element 38 contacts with wall of material 212 at the back 198 of a second roof element 38 and outward step 214 of a roof element 38 contacts with inward step 203. Further, straight portion of material 211 engages with straight portion of front surface 201 of second roof element 38. Lower lip 215 and upper lip 210 form clip-like structures which respectively seal upper and lower surfaces of joint 184.

Lower lip 212, lowest lip 215 and upper lip 210 form clip-like structures which respectively weatherseal top roof surface 188 and lower surface 217 of joint 184. There exist two locking structures across joint 184 which aid in the marrying of roof elements 38 and weatherproofing of joint 184. The first locking structure, generally designated 219, consists of square protrusions 218 and 220 on the front of top roof surface 188 for engaging with the underside of upper lip 210. Protrusion 218 which is closer to front end 197 of roof element 38 is lower in height than protrusion 220 to aid locking and weathersealing with lip 210 of a preceding roof element 38. The first locking structure 219 further consists of a step 216 in a bottom surface 221 of upper lip 210 such that raised bottom surface 221 of lip 210 fits over top surface of protrusion 218. Step 216 is tapered to aid sliding of lip 210 over protrusion 218. A raised vertical protrusion 222 on the end of lip 210 touches protrusion 220 such that there is a seal formed between protrusion 222 and protrusion 220. Water escaping this seal is trapped in a squaroid section orifice 224 formed between protrusion 218 and bottom surface 221 of upper lip 210. The second locking mechanism 225 is situated on lower lip 215. Lowest lip 215 consists of three conduits 226 which trap water escaping downwards beneath upper lip 210 and squaroid section orifice 224 through joint 184. The locking (and weatherproofing) structure 219 and joint 184 are able to be manufactured together with protrusions 186 due to the mode of production of molding utilized to produce "closure on three sides".

These structures facilitate extendibility and interchangeability of components to ensure blow molded roof quality and cost-effectiveness is maintained.

In order to ensure interchangeability of components which maintains cost-effectiveness, back filter bar 200 shown on FIGS. 8B, 8D, 8G and 8H which are now referred to is added to rearmost roof element 38A. Thus rearmost roof element 38A may be the same as all the other roof elements 38 and is adapted for fitting to back panel 36 using backfiller bar 200.

Figure 9:
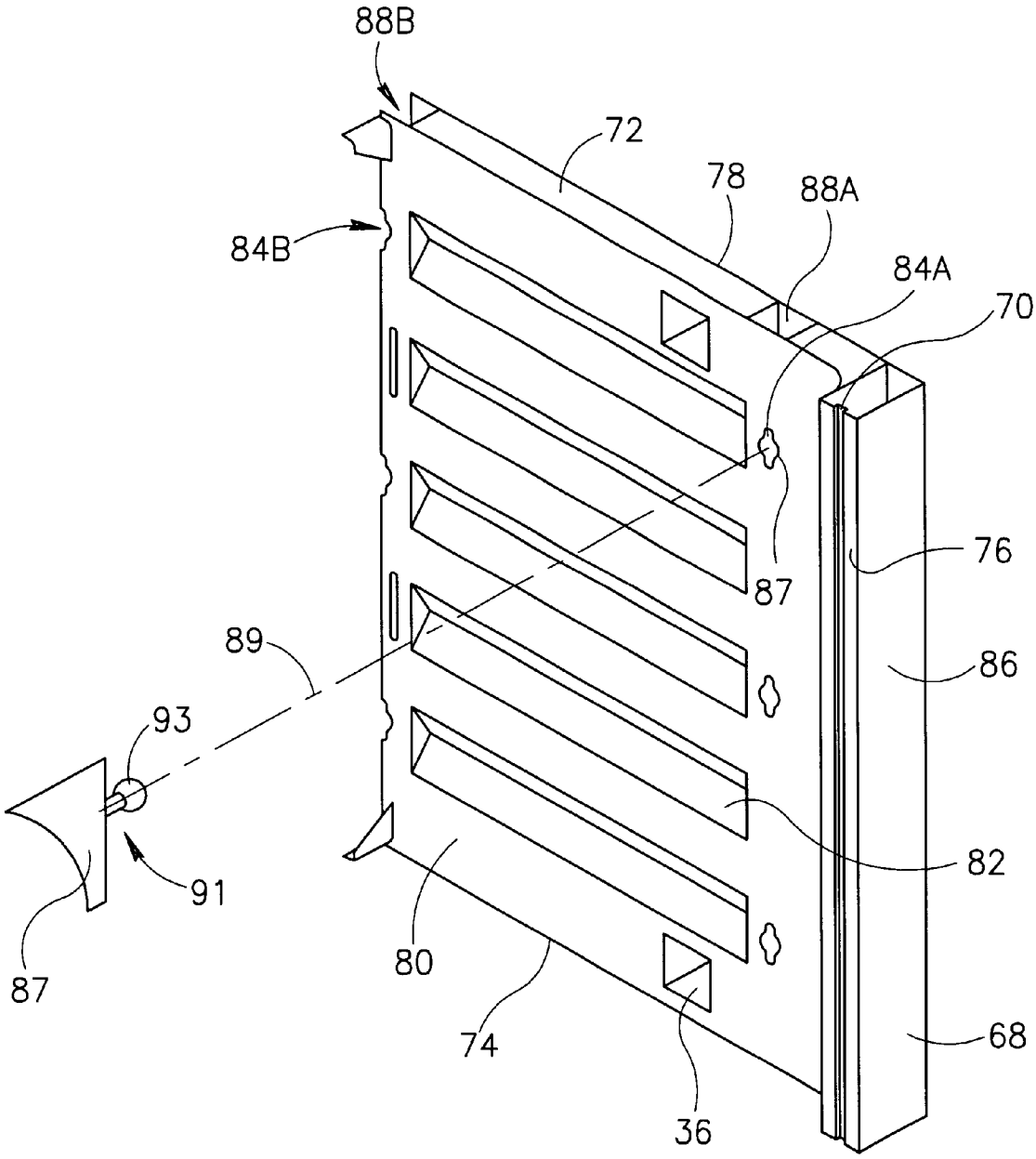
FIG. 9 is an isometric illustration of half a back wall section of an extendible shed according to a preferred embodiment of the present invention.

FIG. 9 which is now referred to is an isometric view of half a back panel 36. Back panel 36 is injection molded from polypropylene as a one piece construction. The edges of back panel 36 are formed of hollow members 68 containing a square-shaped groove 70 in the center of each one which runs from the top 72 to the bottom edge 74 of back panel 36. Groove 70 is situated on a face 76 of hollow member 68 which is distal from the rear edge 78 of back panel 36. Front edge 80 of back panel 36 is seen to be characterized by grooves 82 which are of a triangular cross section. Back panel 36 contains square-like conduits 88 internally running from the top edge 72 of back panel 36 to the bottom edge 74 of back panel 36. There are conduits 88A slightly inboard of each hollow member 86 and a conduit 88B in the center between the two hollow members 86.

Back panel 36 also contains apertures 84 on front edge 80 of back panel 36 close to side edges 86 of back panel 36 and in the center of back panel 36. The apertures closest to edges 86 are labeled 84A and the apertures in the center are labeled 84B. Apertures 84 are used for hanging shelves and consist of a central circular section 87 from which radiate two vertical wings 89. Shelves as are known in the art an rested on supports 87 which contain a connector 91 having a circular insertable peg 93 which enters into central circular section 87 and slides down in wings 89 to secure support 87. This allows half shelves (up to centerline) of back pawl 36 to be constructed. Side panels 34, have similar apertures 84 (not shown ) at intervals along their length to allow a similar flexible length shelving system to be employed.

Back panel 36 lockably fits over and against protrusions 66 in back base panel 32A (FIGS. 3, 7C). Protrusions 66A fit into hollow member 68 from bottom edge 74 in a male-female fashion. Protrusions 66B lockably fit into conduits 88A from bottom edge 74 and protrusion 66C lockably fits into conduit 88B from bottom edge 74.

Figure 10A:
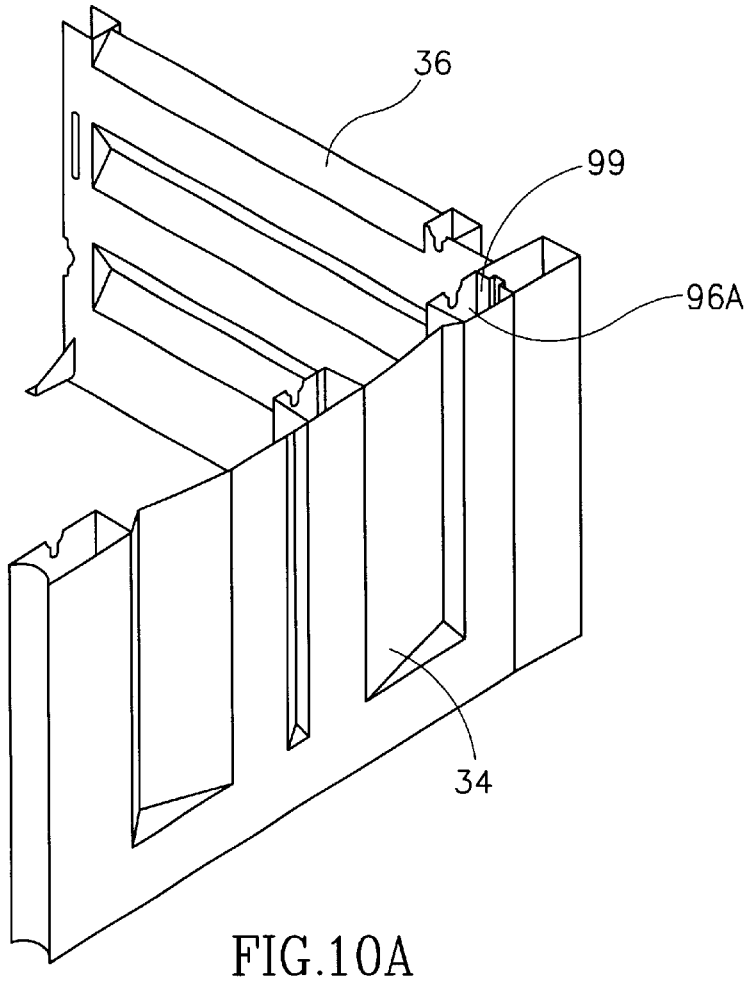
FIGS. 10A–10B are isometric illustrations of the connection between the back wall and a side wall in a preferred embodiment of the present invention.
Figure 10B:
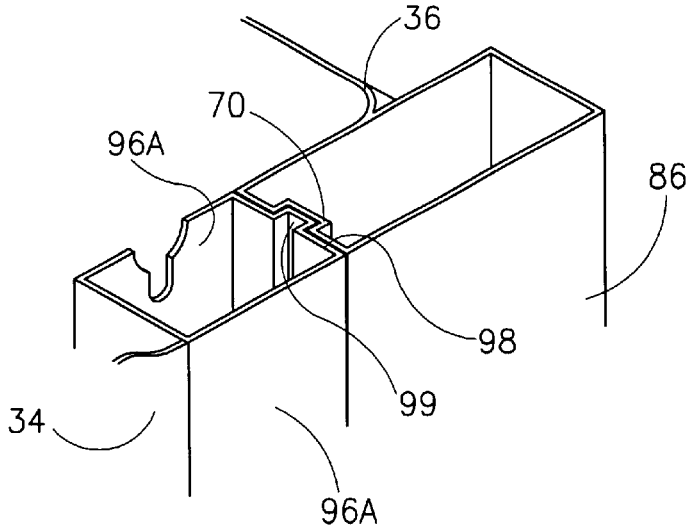

Reference is now made to FIG. 10A which shows back panel 36 joined to side panel 34. FIG. 10B which shows the juncture between back panel 36 and side panel 34 is also referred to. Rib 99 of back edge 98 of conduit 96A slides into groove 70 of side edge 86 of back panel 36 to form a strong weatherproof link between side panel 34 and back panel 36.

Although the height of side panels 34 and back panels 36 may be as high as required, in some cases, and also for transportation and storage reasons, it is not feasible to manufacture them to this length. Thus, they are split utilizing side connectors 44 and 46 respectively, FIG. 11 which shows a height extendible forwardly extendible shed is now referred to. Elements which are shown in previous figures have similar numerals and will not further be described. Side panels 34 are connected by connectors 44 so that the height of shed 30 can be extended to a number of "storeys" (two storeys are shown FIG. 11) Back panels 36 are connected by connectors 46 and door panels 40 are connected by connectors 48 to a similar end. Connectors 48 form a handle element 50 (FIG. 14B, hereinbelow). Upper and lower protrusions in door connectors 48 fit into orifices in upper and lower door panels 40 to height extend or split doors created by panels 40. Protrusions in back connector 106 fit lockably into square-like conduits 88 and hollow members 68 in back panel 36 to connect two back panels 36, one above the other.

Base panels 32, side panels 34, back panels 36, roof elements 38, door panel 40 and connectors 44, 46 and 48 may in a preferred embodiment all be injections molded from polyvinyl as one piece constructions.

Side connectors 44 are universal and will fit any side panel their protrusions 132 (at the front) and 142 at the back fitting into conduits 96C, 96B and 96A respectively in a lockable fashion as shown in FIG. 4. Locking structures 164, as described hereinbelow, at the front of side connectors 44 facilitate locking with a connector in front. Each connector 44 has a circular socket 142 (not shown) as described hereinbelow at the opposite end to locking structure 164 which facilitates male-female type connection between a locking structure 164 and the socket 142 on the back of a previous side connector 44 as described hereinbelow (see FIGS. 12, 13 hereinbelow). Locking structures 114 on back connectors 46 are of the same profile as locking structures on side connectors 44, thus facilitating locking of back connectors with adjacent side connectors 44 via circular socket 142 on adjacent side connector 44 as described hereinbelow (FIGS. 12, 13)

For example, front of side connector 44A locks to back of side connector 44B when forward extension is required in a similar way to the extendibility of one piece side panels a described hereinabove (FIG. 3). Further, door connectors 48 are adapted to many with locking structure 164 on side connectors 44 to form a hinge mechanism 272 as described hereinbelow (FIG. 14). Thus doors 40 may be attached to any front face of side panel 34, even when height extending side connectors 44 are employed. Extension is achieved by removal of doors 40, addition of (height extended) side panels 34 and replacing doom 40 on the front of new side panels 34 in a similar way to that described hereinabove for unitary side panels 34 (FIG. 3).

In other words, when side connectors 44 are used to split side panels 34 of to extend side panels 34 upwardly side connectors 44 mimic the interchangeability and universality of side panels 34 and do not hinder forward extendibility. They too are designed for forward extendibility and interchangeability via universal male-female connections. Thus forward extendibility and interchangeability is maintained in the usual manner as described hereinabove for a shed 30 having one-piece side panels 34.

Reference is now made to FIGS. 12A–12E which show isometric and elevational views of back panel connector 46. FIGS. 12A–12D are now more particularly referred to. Back panel connector 46 is a member 105 with corners 107 and with squaroid protrusions 106 along its length which are hollow and conduit-like and protrude a number of centimeters above a top edge 108 and a number of centimetres beneath a bottom edge 110 of connector 46. Protrusions 106A are situated on the corners 107 of back panel connector 46 and protrude forward of the width of member 105. Protrusions 106B are situated at the edges of back panel connector 46 slightly inboard of the corners and protrusion 106C is at the center of back panel connector 46. Protrusions 106 are in the same orientation and of slightly smaller dimensions than conduits 88 and hollow member 68 in back panel 36 to enable them to slideably fit into conduits, 88 and hollow member 68 to form a tight fit. Thus the height of shed 30 may be extended at the back in increments of the height of a back panel by slideably fitting a back panel connector 46 into conduits 88 and hollow member 68 in the top edge 72 of back panel 36 and slideably fitting a new back panel 36 above in a similar manner.

Figure 12A:
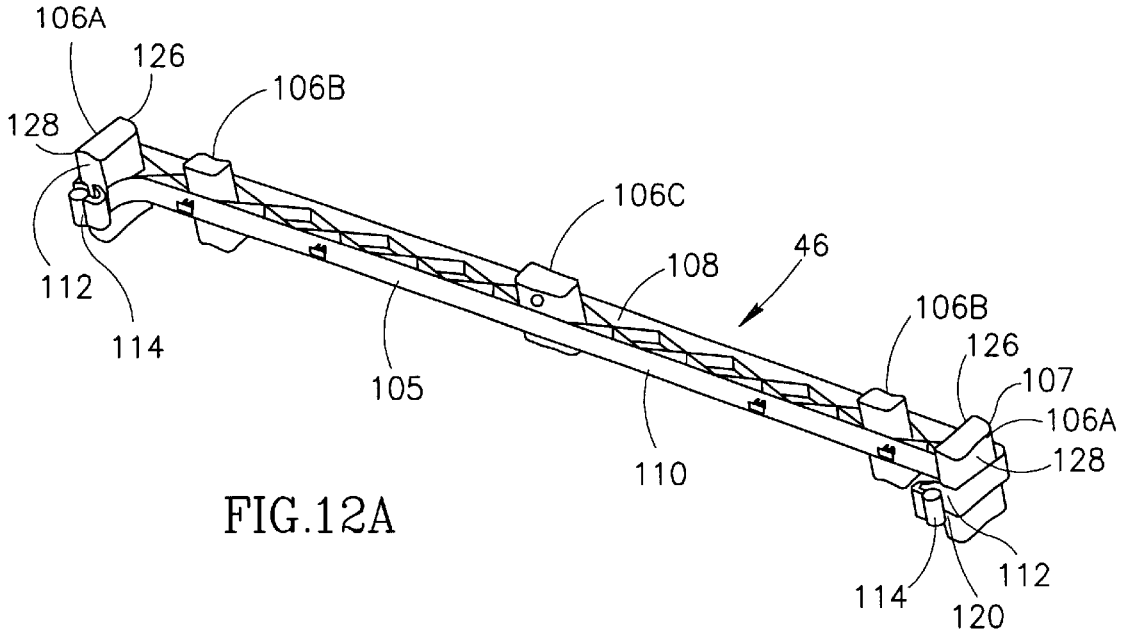
FIG. 12A is an isometric illustration of a back-panel connector of an extendible shed according to a preferred embodiment of the present invention.
Figure 12B:
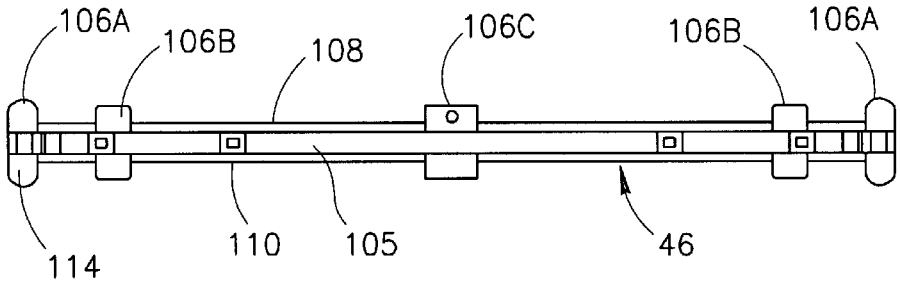
FIGS. 12B–12D are front, top and back elevations of the back-panel connector of FIG. 12A according to a preferred embodiment of the present invention.
Figure 12C:
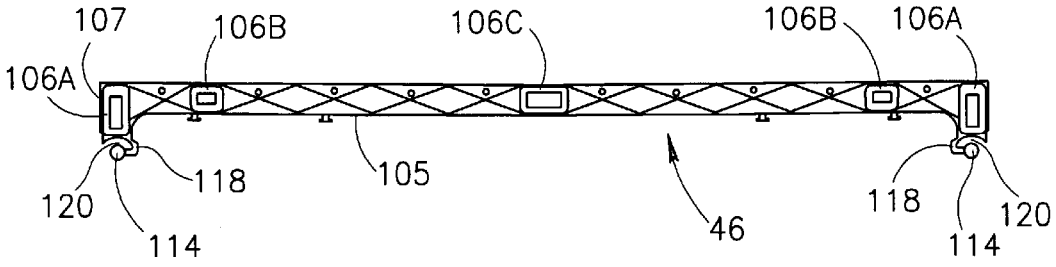
Figure 12D:
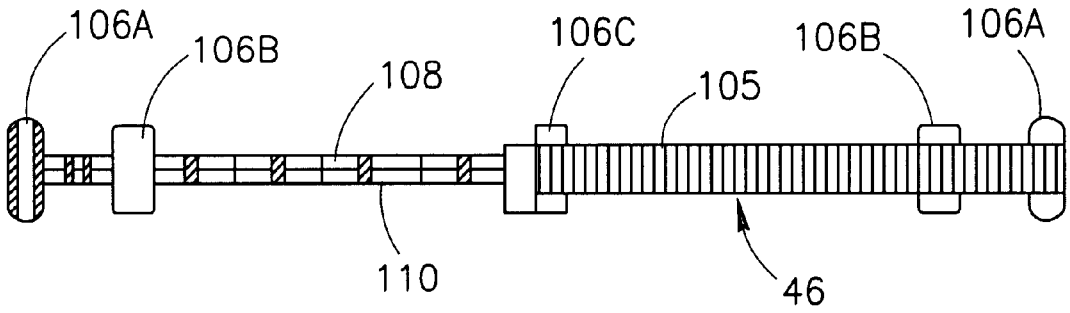
Figure 12E:
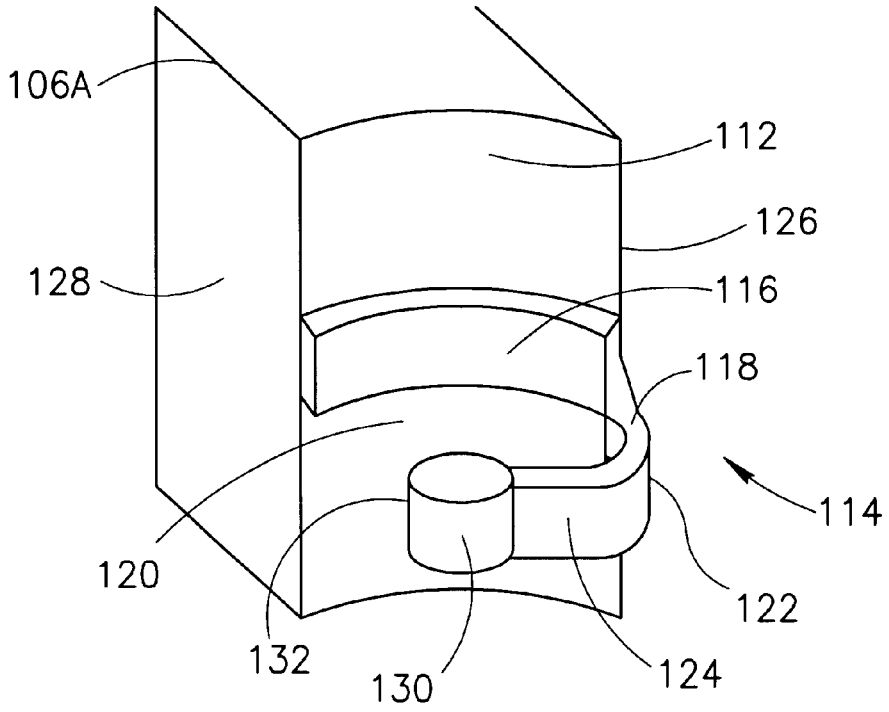
FIG. 12E is an isometric illustration of a hook-like locking structure attached to the back panel connector.

Protrusions 106A situated on the corners of back panel connect 46 have attached to their front face 112, a locking structure 114 shown isometrically on FIG. 12A and in plan on FIG. 12C. A lager isometric view of locking structure 114 molded to protrusion 106A is shown on FIG. 12E. Locking structure 114 is molded in the center of front face 112 of protrusions 106A and is an integral part of protrusions 106A. Locking structure 114 consists of a semi circular trough-like shaped structure 116, raised in a lip-like fashion from the front face 112 of protrusion 106A and a hook-like structure 118. The anterior portion of hook-like structure 118 forming the side of a semi-circular trough-like area 120. At the end 122 of anterior portion of hook-like structure 118, hook-like structure 118 is formed of a straight portion 124 parallel to front face 112 of protrusion 106A. Straight portion 124 parallel to front face 112 is straight and level and runs from side 126 of protrusion 106A in the direction of side 129. Straight portion 124 ends in a circular disc-like structure 130 of equal height to trough-like shaped structure 116. The end of disc-like structure 132 distal to side 126 of protrusion 106A is aligned with the center-line of front face 112 between side 126 and side 128. FIG. 12E shows protrusion 106A wherein side 126 is an inward facing side and side 128 is an outward facing side. This serves illustrate disc-like structure 130 faces outward on each protrusion 106A as illustrated on FIGS. 12A–12E.

Figure 13A:
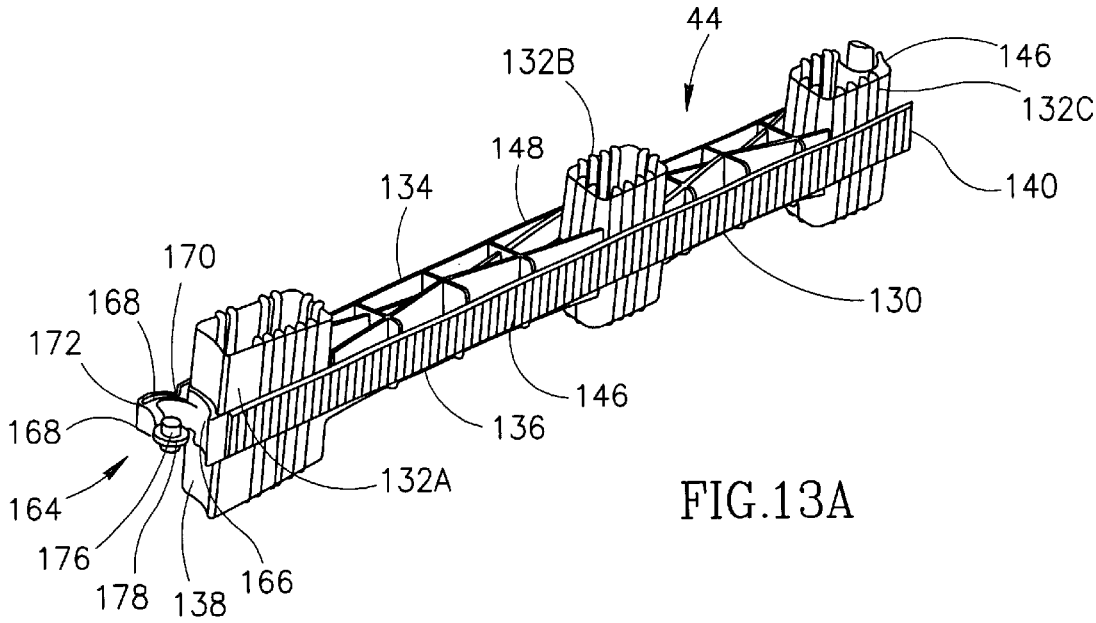
FIG. 13A is an isometric illustration of a side-panel connector of an extendible shed according to a preferred embodiment of the present invention.
Figure 13B:
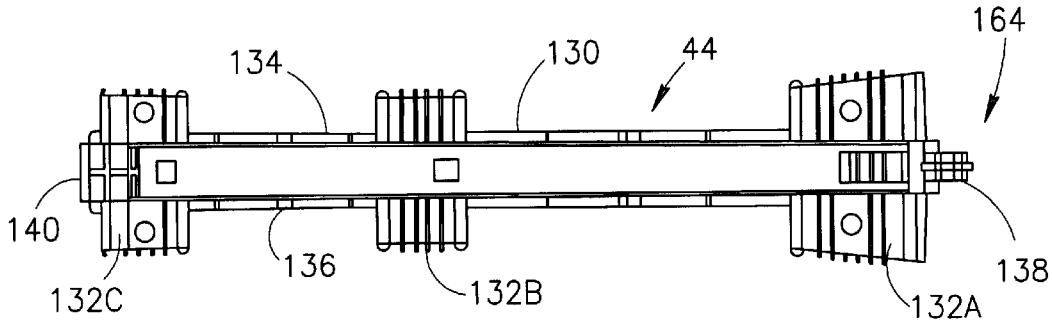
FIGS. 13B–13D are front, top and back elevations of the side-panel connector of FIG. 8A according to a preferred embodiment of the present invention.
Figure 13C:
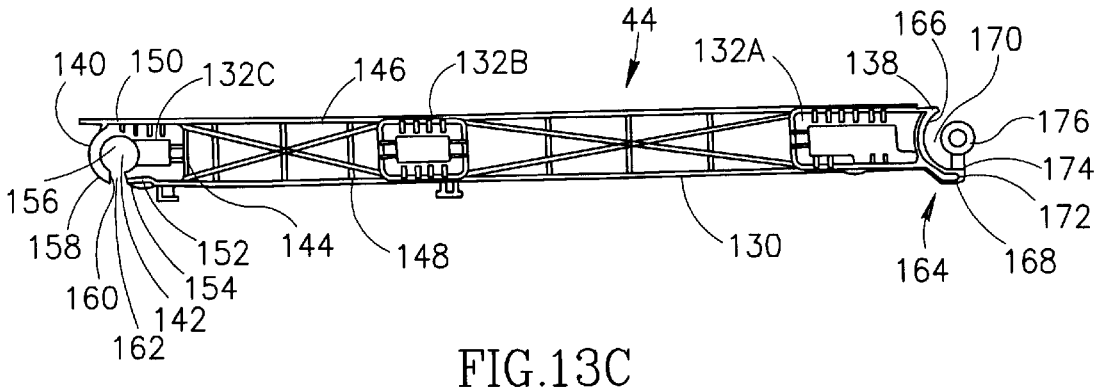
Figure 13D:
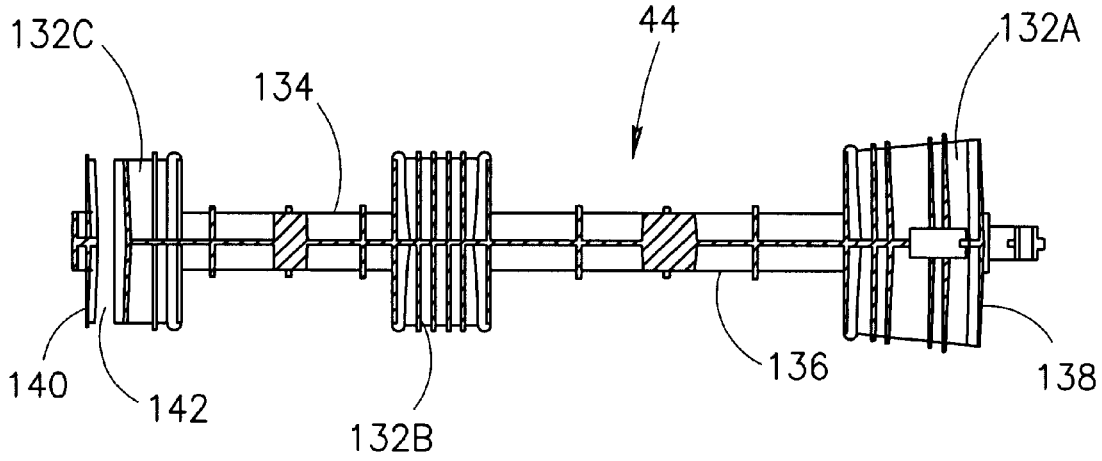
Figure 13F:
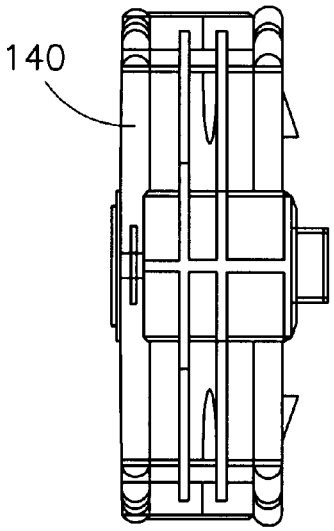
FIGS. 13E–13F are side elevations of the side-panel connector of FIG. 13A according to a preferred embodiment of the present invention.
Figure 13E:
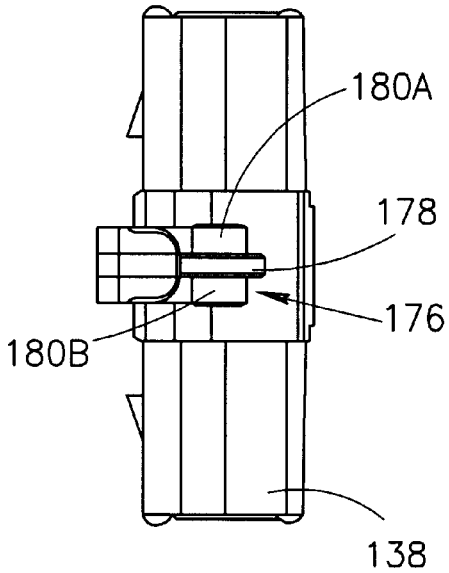

FIGS. 13A–13F which show a side panel connector in various orientations are now referred to. FIG. 13A is an isometric illustration of a side panel connector of an extendible shed according to a preferred embodiment of the present invention. FIGS. 13B, 13C and 13D show a front elevation, top elevation and back elevation of a side panel connector according to a preferred embodiment of a present invention. FIGS. 13E and 13F an side elevations of a side panel connector according to a preferred embodiment of the present invention.

Side panel connector 44 is a member 130 with squaroid protrusions 132 along its length which are hollow mid conduit-like and protrude a number of centimeters above a top edge 134 and a number of centimeters beneath a bottom edge 136 of connector 44. Protrusion 132A is situated at the back edge 138 of connector 44 and is rectangular in section. Protrusion 132A is tapered when viewed in side-elevation (FIG. 13B) from a wide end closest to back edge 138 of connector 44 to a narrower edge closest to a front edge 140 of connector 44. The longer dimension of the squaroid plan section of protrusion 132A runs in the direction of front edge 140 from back edge 138. Protrusions 132B is situated closer to front edge 140 than to back edge 138 as shown in FIGS. 13A, 13B and 13D.

Protrusion 132C is situated at front edge 140 and forms part of front edge, 140. Protrusion 132C forms a circular socket 142 in addition to its squaroid from in plan view (FIG. 13C) on three kites. The squaroid form an three sides consists of a straight side 144 parallel to back edge 138 of connector 44 whose width is substantially the width of member 130 from a front face 146 of member 130 to a back face 148 of member 130. The squaroid form in plan view (FIG. 13C) further consists of a straight wall 150 adjacent to front face 146 and a straight wall 152 adjacent to back face 148. Circular socket 142 is formed of a short straight wall of material 154 running the full height of protrusion 132C joined to a circular wall of material 156 of the same height. The portion of circular socket 142 distal from back edge 138 of connector 44 is formed of a hook-like structure 158 at front end 140 of member 130. Hook-like structure 158 is of a wall thickness of a short straight wall 160 at its end. Wall 154 faces wall 160 to form an opening 162 to socket 142. A general side elevation of member 130 showing front end 140 of member 130 is shown at FIG. 13F.

Back edge 138 of connector 44 has attached to it a looking structure 164, shown isometrically on FIG. 13A and in plan on FIG. 13C. FIG. 13B shows a side elevation of connector 44, viewing from back edge 138. FIGS. 13B and 13D also show locking structure 164. Locking structure 164 is molded in the center of back edge 138 of connector 44 and is at integral part of same. Locking structure 164 consists of a semi-circular trough-like shaped structure 166 raised in a lip-like fashion from back edge 138 and a hook-like structure 168. The anterior portion of hook-like structure 168 forming the side of a semi-circular trough-like area 170. At the and 172 of anterior portion of hook-like structure 168, hook-like structure 168 is formed of a straight portion 174 parallel to back edge 138 of connector 44. Straight portion 174 parallel to back edge 138 is straight and level and runs from back face 148 of member 130 in the direction of front face 146 of member 130. Straight portion 174 ends in a circular disc-like structure 176 of equal height to hook-like structure 168. Disc-like structure 176 consists of a thin disc 178 of large circumference forming the center of disc-like structure 176 together with an upper disc 180A and a lower disc 180B, both of smaller circumference, above and below thin disc 178 (FIG. 13E). FIG. 13F shows front end 140 of member 130 from behind.

Figure 11:
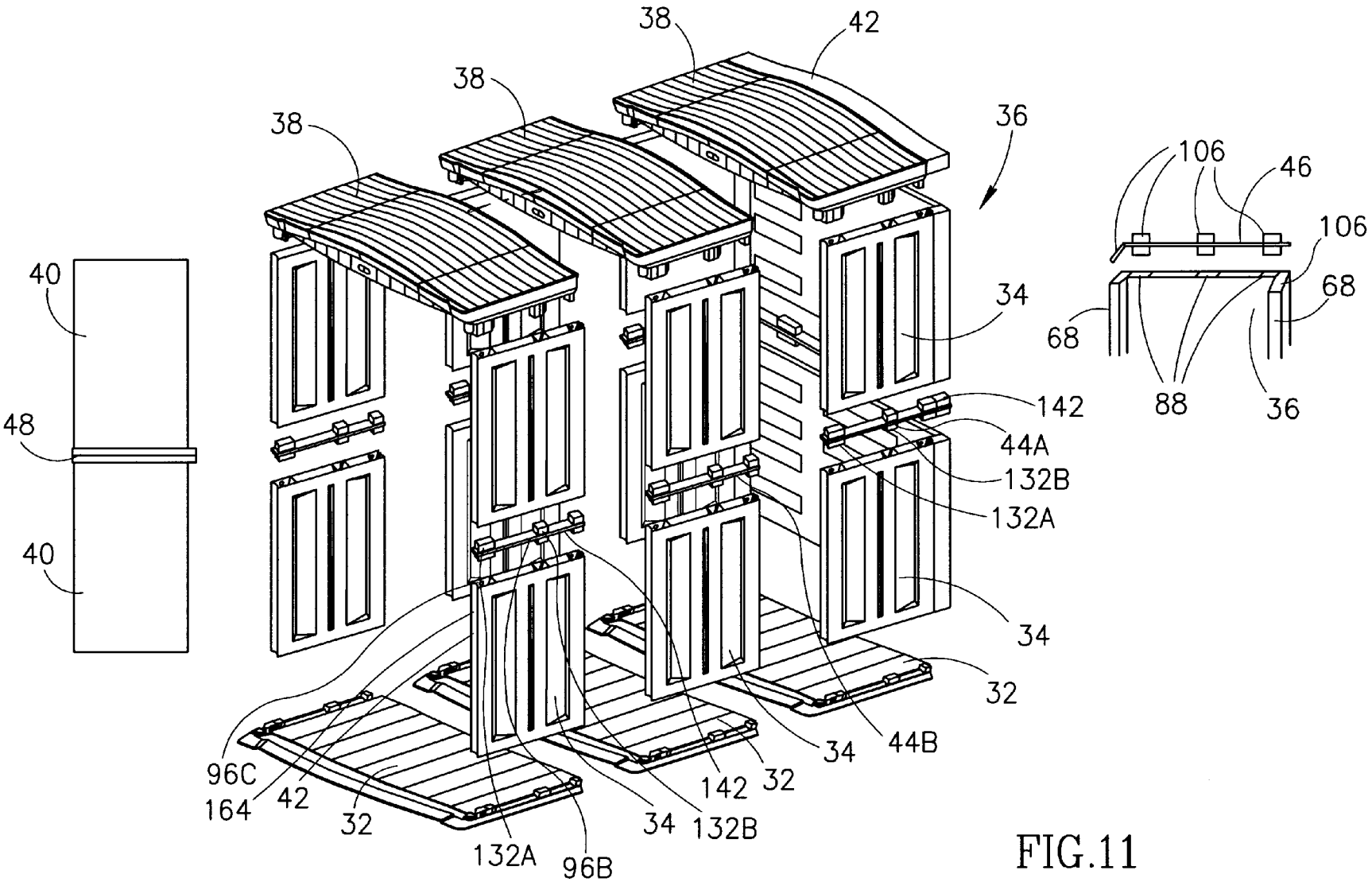
FIG. 11 is an isometric illustration of an extendible shed in various stages of construction according to a preferred embodiment of the present invention.
Figure 13G:
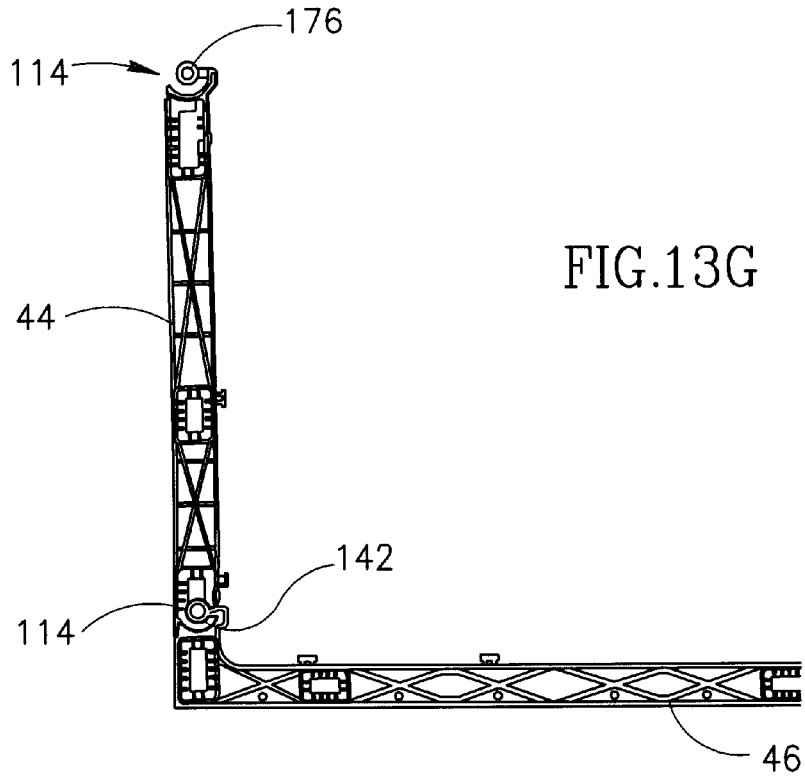
FIG. 13G is an isometric illustration of the mode of connection of a back connector and a side connector according to a preferred embodiment of the present invention.

FIG. 13G which is now referred to shows a back connector 46 connected to a side connector 44 by the co-operation of locking structure 114 of back connector 46 with circular socket 142 of side connector 44 to form a right angle. The co-operation facilitates the connection of back panel 36 with side panel 34 and the connection of successive storeys of shed 30 as described hereinabove (FIG. 11).

Figure 13H:
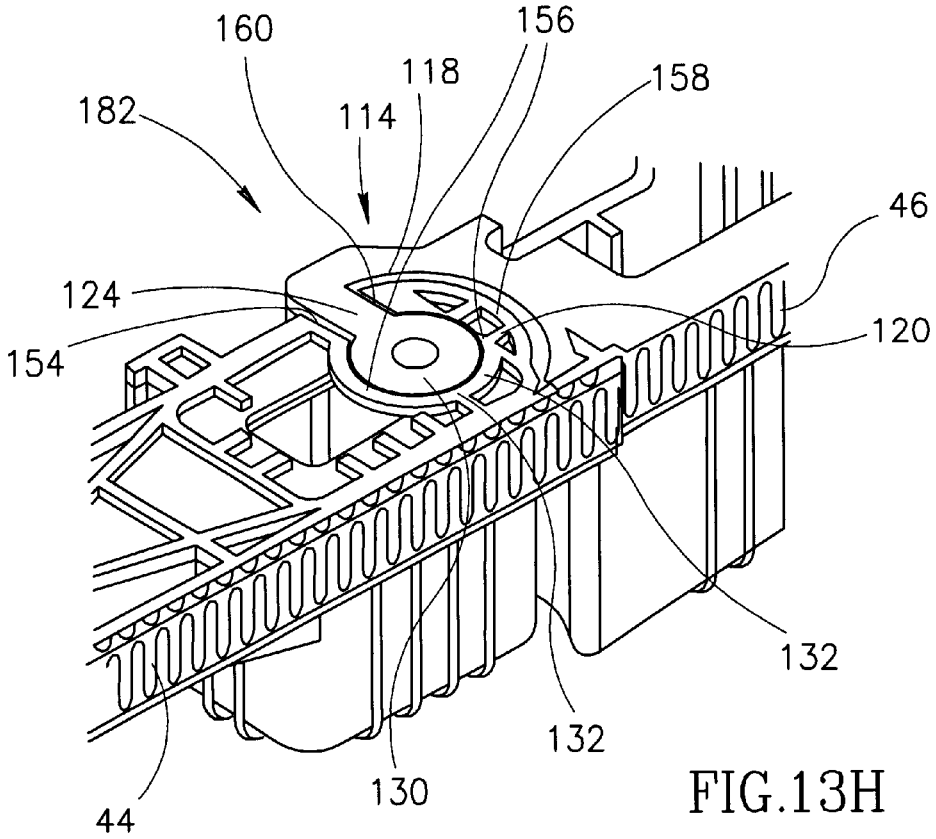
FIG. 13H is an isometric illustration of the universal locking connection system utilized to connect side and back connectors, side and side connectors and side and hinge connectors according to a preferred embodiment of the present invention.
Figure 13I:
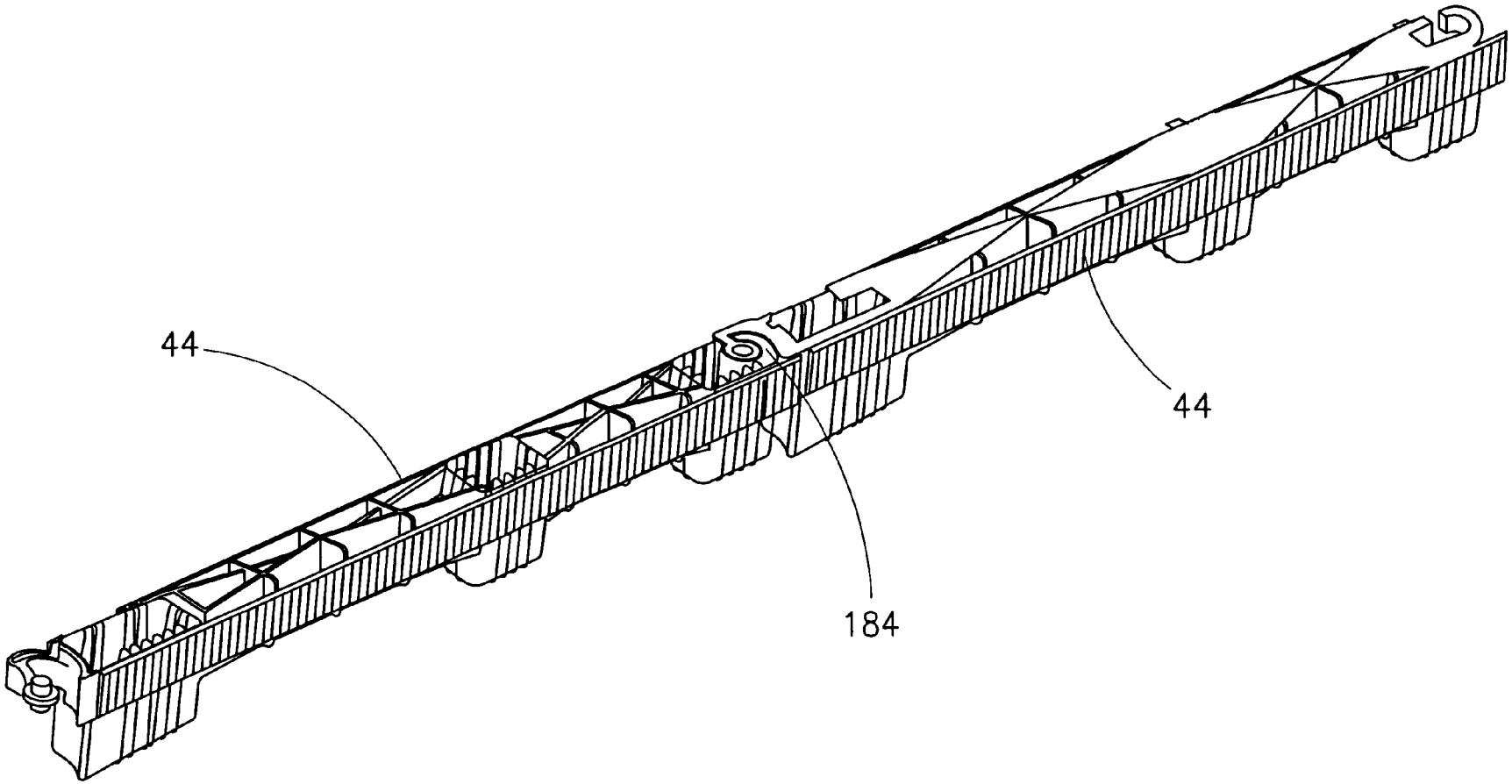
FIG. 13I is an isometric illustration of two side connectors connected utilizing the locking connection system of FIG. 13H.

FIG. 13H, which is now referred to, shows the co-operation between circular socket 142 of side connector 44 and locking structure 114 of back connector 46 in closer detail. In fact, FIG. 13H shows a transverse section through the center of back connector 46 and side connector 44 for ease of viewing of the joint 182. The locking of back connector 46 to side connector 44 is accomplished by joint 182, Circular disc-like structure 132 of locking structure 114 on back connector 46 slides longitudinally into circular socket 142 of side connector 44. A tight fit is formed between the surface of disc-like structure 132 of back connector 46 and circular wall of material 156 of side connector 44. A tight fit is also formed between trough-like shaped structure 116 on locking structure 114 on back connector 46 (FIG. 12E), and the front face of hook-like structure 158 at front end 140 of member 130. Rotational movement of joint 182 is prevented by contact between short straight wall of material 154 of circular socket 142 and a front edge of straight portion 124 of hook-like structure 118. Further, rotational movement of joint 182 is prevented by contact between short straight wall 160 of circular socket 142 and a back edge of straight portion 124 of hook-like structure 118. FIG. 13I which is now referred to depicts the connection between two side connectors 44 and shows the joint 184 between them. Side connectors 44 fit together in the same way as side connector 44 and back connector 46 as described hereinabove.

Thus far, it bas been illustrated that shed 30 be extended forwards in an unlimited way by adding more forward base panels 32B mid 32C together with the requisite number of universal side panels 34 connected by side connectors 44. Universal back panels 36 we connected to side panels 34 using backconnectors 36. The universiality of the side connectors makes for cost-effective extendibility, similarly the universiality of the connection between back and side connector and side and side connector makes for cost-effective extendibility. Likewise for the back panels 36 and side panels 34. Shed 30 can also be extended upwards in an unlimited cost-effective way using the standard components (FIG. 3, FIG. 11).

Figure 14A:
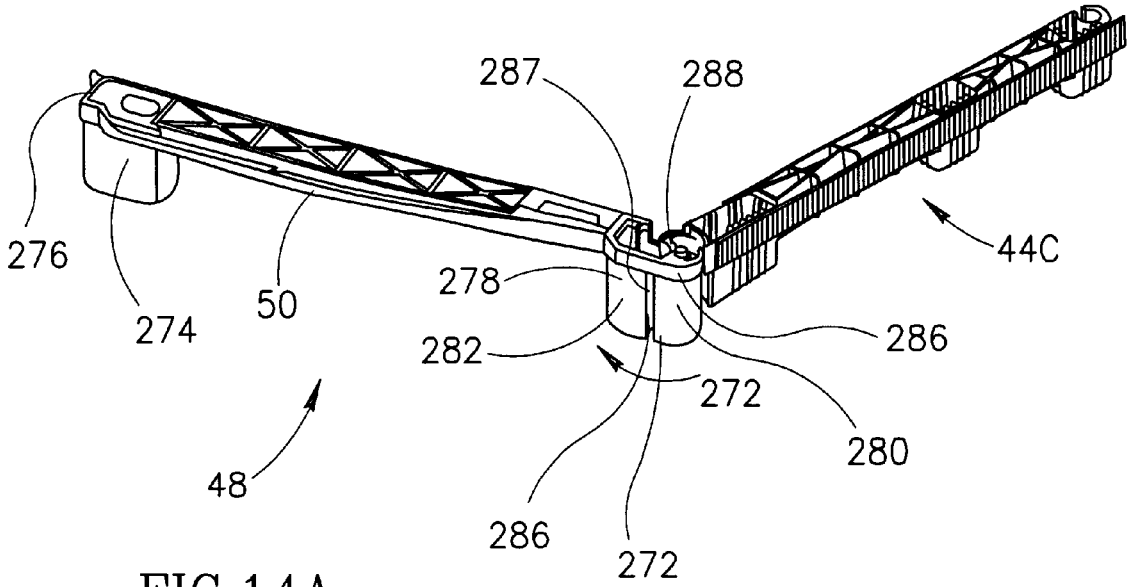
FIG. 14A is an isometric view of a handle section of a door panel showing how it articulates with a side connector to form a hinge.
Figure 14B:
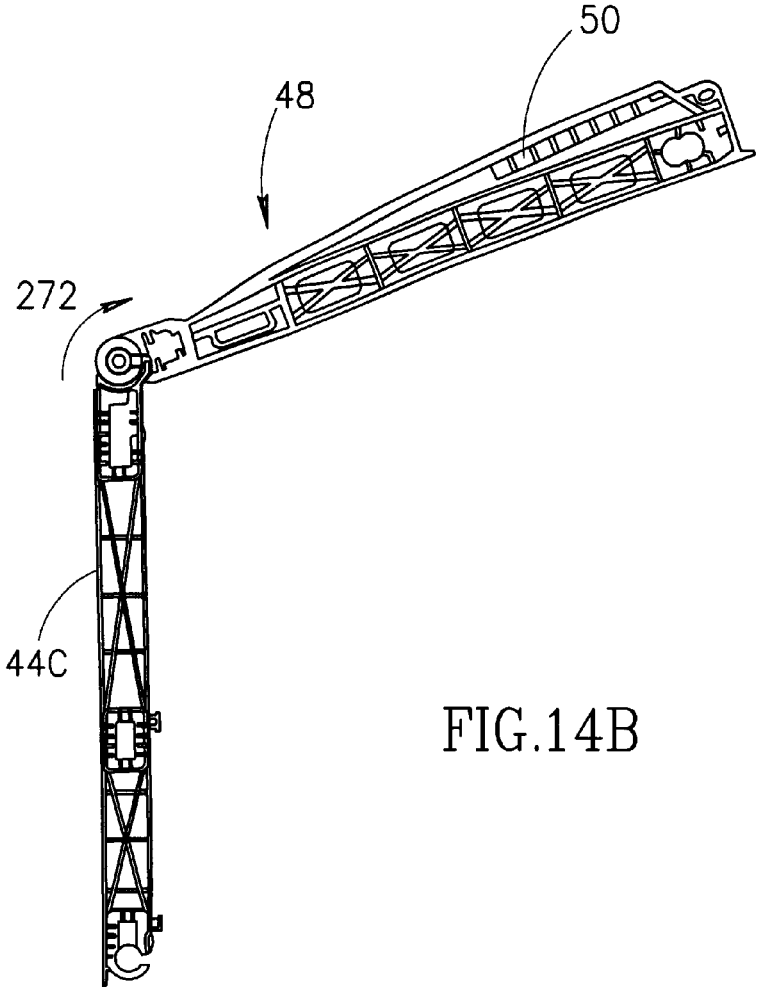
FIG. 14B is a top view of a handle section of a door panel showing how it articulates with a side connector to form a hinge.
Figure 14C:
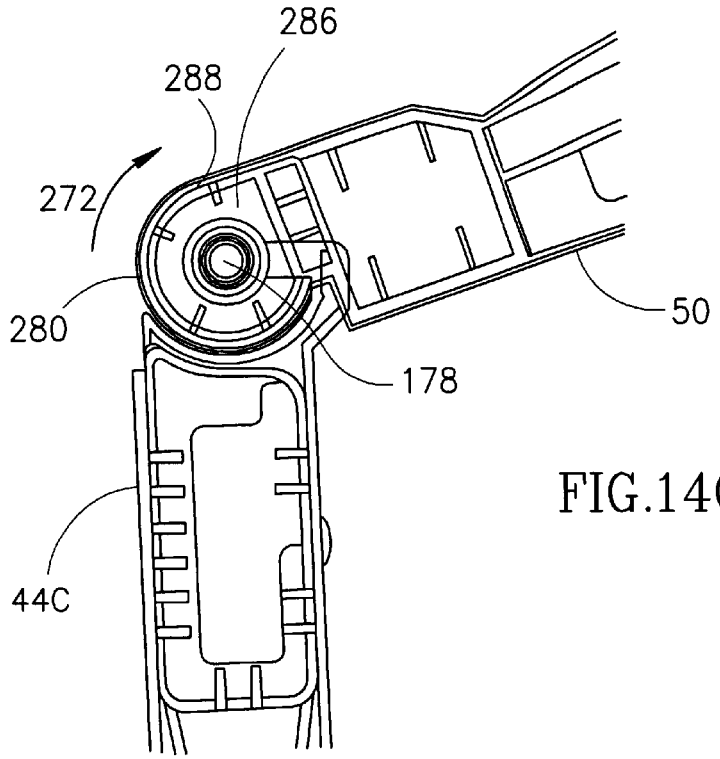
FIG. 14C is a top view of the hinge connecting a handle and a side connector.
Figure 14D:
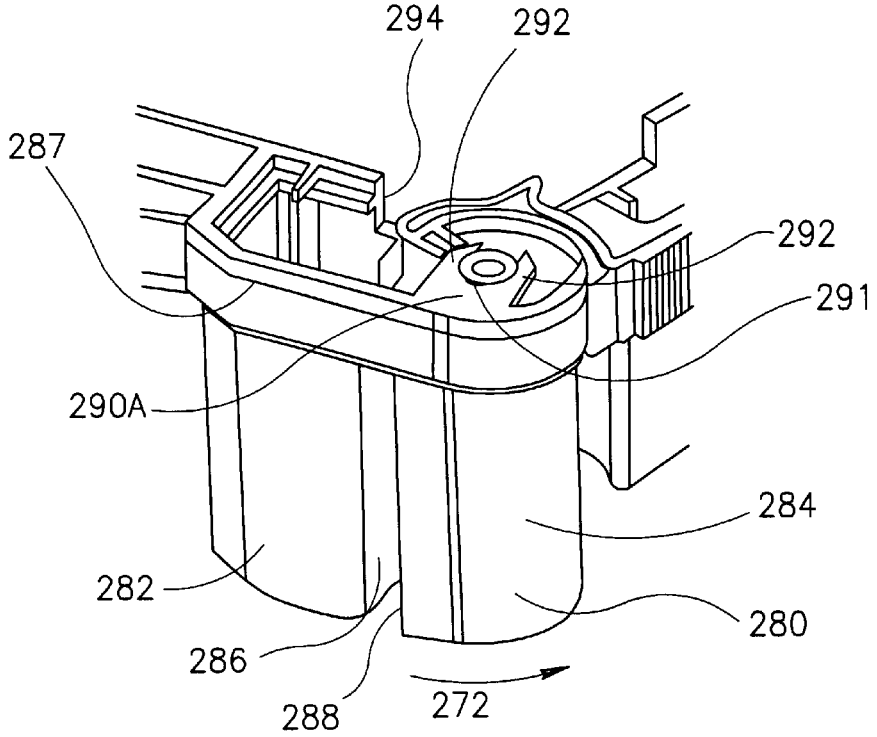
FIG. 14D is an isometric view of the hinge connecting a handle and a side connector and FIG. 14E is an isometric illustration of disc-like structure attached to the end of a side connector showing the mode of engagement of hinge clips of a door connector therewith.

FIG. 14A is an isometric view of a left-hand door connector 48 axially sliced and connected to a frontmost side connector 44C (also axially sliced) via hinge mechanism 272. FIG. 14C is a plan view of hinge mechanism 272 and FIG. 14D, is an enlarged isometric view of hinge mechanism 272. Door connector 48 has a downward facing squaroid protrusion 274 at a front end 276 and a hinge assembly 278 at a rear end 280. Squaroid protrusion 274 fits into squaroid conduit 256 of door panel 40 in a tight-fitting locking manner. Likewise, an upper protrusion (not shown) on the upper half of connector 48 fits into squaroid conduit 256 of a door panel 40 above door connector 48.

Hinge assembly 278 consists of two thin-walled hollow protrusions, namely a squaroid protrusion 282 mid a semi-circular protrusion 284 with a gap in between. Facing the gap are straight wall 286 of protrusion 282 and straight wall 288 of protrusion 284. Protrusions 282 and 284 slideably fit into conduits 254 and 248 respectively to form a tight locking seal. Straight walls 286 and 288 engage wall 264 between conduits 248 an 254 of door panel 40. Protrusions 282 and 284 meet a collar 287 of a few centimetres in height which surrounds hinge mechanism 272. Above collar 287 are further protrusion 282 and 284 (not shown) extending upwards and connecting to a higher door panel 40.

Figure 14E:
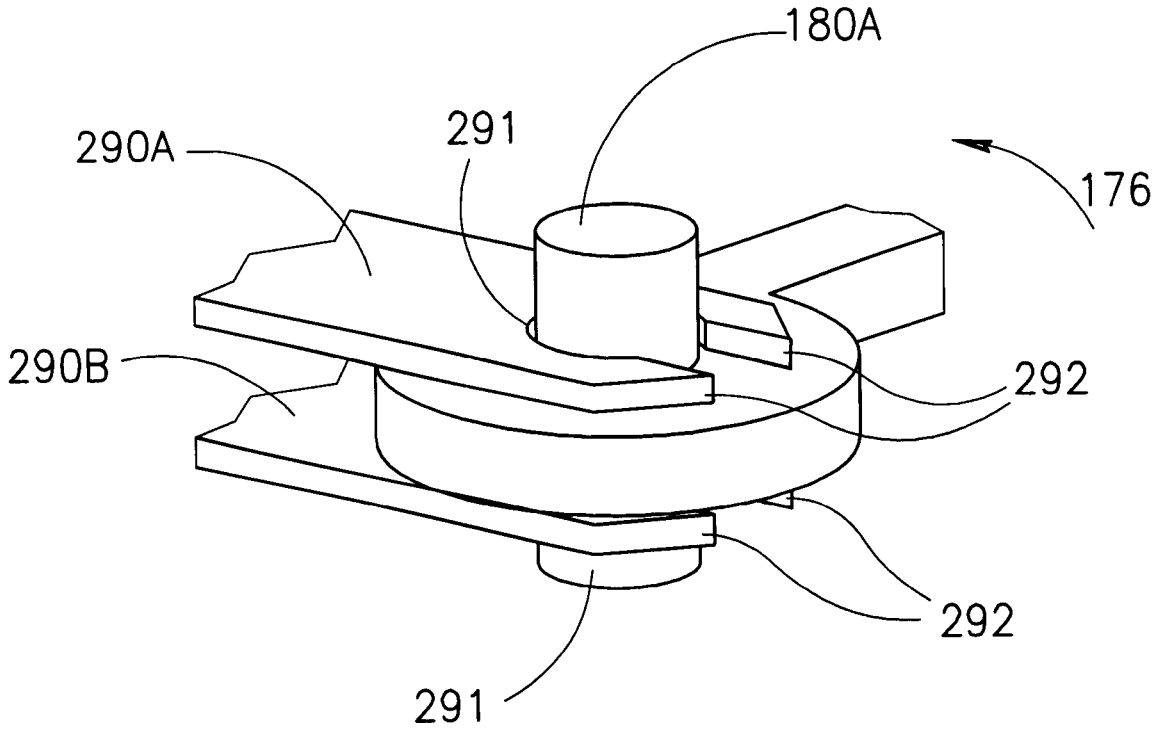

FIGS. 14C and 14D showing hinge mechanism 272 are now more particularly referred to. FIG. 14E which is an isometric view of disc-like structure 176 of hook-like structure 168 of side connector 44 is also referred to. Hinge mechanism 272 consists of clips 290 projecting rearwards from a rear edge 288 of collar 287. There is an upper clip 290A and a lower clip 290B (not shown). Clips 290 have two calipers 292 each, forming a slot with a semi-circular apex 291. Calipers 292 are a vertical distance apart so as to engage upper and lower surface of thin disc 178 of hook-like structure 168 on side connector 44 (FIG. 13A, FIG. 13E). Calipers 292 springably engage and grip upper disc 180A and lower disc 180B to allow rotation of clips 190 around upper disc 180A and low disc 180B in a hinge-like fashion. A squaroid aperture 294 in collar 287 (FIG. 14D) facilitates access of hook-like structure 168 of side connector 44 in order for disc-like structure 176 to engage clips 290. Rear end 280 of door connector 48 including collar 287 is rounded so that when door 40 is opened, collar 287 of door connector 48 articulates with semi-circular trough-like shaped structure 166 of side connector 44. The general trough-like shape of side connector 44 above and below semi-circular trough-like shaped structure 166 allows congruent movement of the outer surface of semi-circular protrusion 284 when door 40 is opened.

It is thus apparent that door connector 48 facilitate height extendibility with forward extendibility. Height extendibility is ensured by the fact that a number of "storeys" of doors may be built as required. Forward extendibility and interconnectability are ensure because ay side panel 34 and side connector 44 may serve as the front most wall as a universal connecting hinge mechanism 272 allows articulation of doors 40 placed adjacent thereto. Further, hinge mechanism 272 adds strength to doors 40, preventing forced entry from the sides. This aids forward extendibility in that it allows doors 40 to be mounted directly onto front side panels 34 allowing universiality of side panels 34 for the purpose of serving as frontmost side panel 34.

The universality of roof elements 38 facilitates forward extendibility in that any roof element 38 may serve as frontmost roof element 38 and bosses 187 are designed to articulate with protrusions 284 in doors 40, in a hinge-like manner. Likewise for base panels 32. The design of doors 40 insofar as they have curved surfaces for articulating with side-panels 34 also contributes to compatibility and aiding of forward extendibility, as does the curved nature of the front edge of side-panels 34.

Roof elements 38 are manufacture to be of blow-molded quality whilst exhibiting all the forward extendibility and interchangeability advantages which give an economic premium. An economic premium is achieved due to the low number of parts— roof elements are of a single molding— and the interchangeability advantage. Indeed, the economic premium is a benefit of all the parts of shed 30 for similar reasons.

It will be appreciated that the present invention is not limited by what has been described hereinabove and that numerous modifications, all of which fall within the scope of the present invention, exist. For example, the exact shape of roof, side and connector locking components may vary so long as the functions remain.

It will be appreciated by persons skilled in the art that the present invention is not limited by what has been particularly shown and described herein above. Rather the scope of the invention is defined by the claims which follow:

what is claimed is:

1. An extendable shed comprising:

at least one back panel capable of being vertically connected by at least one back connector to another back panel;

at least one front panel capable of being vertically connected to another front panel by at least one connector; and at least one module unit, said at least one module unit comprising:

base panel;

at least one pair of side panels capable of being vertically connected by at least one side connector to another pair of side panels, wherein one of said at least one pair of side panels is connected to different sides of said base panel: and a roof panel connected to one of said at least one pair of side panels, wherein said at least one module unit is capable of being horizontally connected to another module unit, and wherein one of said at least one module units is attached to said at least one back panel and one of said at least one module units is attached to said at least one front panel.

2. The shed according to claim 1 and further comprising at least one hinged connector for hingeably connecting said at least one front panel to at least one of said at least one pair of side panels.

3. The shed according to claim 1 wherein said at least one front panel is generally flat having a top end and a bottom end and wherein said at least_one front panel comprises a substantially semi-circular conduit at a side edge of said at least one front panel and a first conduit inward of said semi-circular conduit and wherein said semi-circular conduit hingeably connects with said roof panel of one of said at least one module units and with said base panel of one of said at least one module unit and wherein said at least one front panel has a second conduit distal of said first conduit at a far edge of said at least one front panel and wherein said first conduit protrudes backwardly further than said semi-circular conduit to rest against inner wall of said at least one pair of side panels to stop movement of said at least one front panel and wherein said semi-circular conduit begins with a short wall parallel to a front surface of said at least one front panel said short wall articulating with a side edge of said at least one pair of side panels and wherein said semi-circular conduit continues with a circular wall which curves towards said front surface of said at least one front panel to eventually straighten and merge with said front surface wherein backward facing portion of semi-circular conduit articulates with a forward curved surface of said at least one pair side panels and wherein said at least one front panel connects vertically via said first and second conduits with said at least one hinged connector and a second front panel.

4. The shed according to claim 3 wherein each of said at least one hinged connector has a first and second protrusion at a front end protruding above and below an upper and a lower surface of said at least one hinged connector and a hinge assembly at a rear end containing a hinge mechanism and wherein said hinge assembly has a thin-walled squaroid hollow protrusion and a thin-walled semi-circular protrusion with a gap in between protruding above and below a collar surrounding said hinge mechanism and wherein said first and second protrusions and said semi-circular protrusion slideably fit into said conduits in said at least one front panel and wherein straight internally facing walls of said thin-walled squaroid protrusion and said thin-walled semi-circular protrusion engage a wall between squaroid and semi-circular conduits in said at least one front panel.

5. The shed according to claim 4 wherein said hinge mechanism comprises an upper clip and a lower clip, projecting rearwards from a rear edge of front face of said collar and wherein each of said upper clip and lower clip have two calipers, each of said calipers forming a slot with a semi-circular apex and wherein said calipers are a vertical distance apart so as to engage an upper and a lower surface of a thin disc of hook-like structure of said at least one side connector and wherein said calipers springably engage and grip an upper disc and a lower disc respectively in a hinge-like fashion to facilitate rotation of said clips around said upper and lower discs and wherein a squaroid aperture in rearmost wall of said collar facilitates access of said hook-like structure of said at least one side connector to engage said clips and wherein said rear end of said at least one hinged connector and said collar are rounded so that when said at least one front panel is opened said collar articulates with a trough-like front edge of said at least one pair side panels and wherein the general trough-like shape of said side connector above and below said semi-circular trough-like shaped structure facilitates congruent movement of said outer surface of said semi-circular protrusion when said at least one front panel is opened.

6. The shed according to claim 2 and wherein said at least one front panel functions as at least one door.

7. The shed according to claim 1 wherein said base panel comprises:

at least one front to back locking system connecting a first base panel of a first module unit and a second base panel of second module unit together, wherein said at least one front to back locking system comprising:

a front sloped edge of said a tray-like structure separated from a main flat surface of said first base panel by a trough-like recess; and a rear edge of a second main flat surface of said second base panel extending beyond, side edges of said second base panel and forming protrusions, wherein said rear edge of said second base panel is adapted to fit within said trough-like recess of said first base panel.

8. The shed according to claim 1 wherein each of said at least one pair of side panels comprising:

a rectangular sheet having a front edge, a back edge, a top end and a bottom end; and first, second and third conduits running internally from said top end to said bottom end.

9. The shed according to claim 8 wherein said first conduit runs adjacent to said back edge, said back edge has a square section rib protruding the length of said back edge in a central position of said back edge, said second conduit runs in a central position between said front edge and said back edge, said front edge being formed of substantially semi-circular trough-like surface, and said third conduit runs adjacent to said front edge.

10. The shed according to claim 1 wherein said at least one back panel comprising:

side edges formed of hollow members, each of said hollow members contains a square-shaped groove in the center of said hollow member which is distal from a rear edge, and runs from a top edge to a bottom edge of said at least one back panel;

a plurality of conduits internally running from said top edge to said bottom edge and wherein two of said plurality of conduits are situated slightly inboard of said hollow members and one of said plurality of conduits is situated in a central position between said hollow members; and a front edge having apertures proximal to said side edges central between side edges wherein said apertures are a central circular section from which radiates two vertical wings.

11. The shed according to claim 10 wherein said at least one back panel further comprising:

a plurality of shelves having protrusions, said plurality of shelves being inserted into said central circular section of said aperture and lockably slid downwards so that a rear surface of circular disc articulates with an internal surface of said at least one back panel behind said apertures.

12. The shed according to claim 1, wherein said at least one side connector has a top edge and a bottom edge, said at least one side connector comprising a member having protrusions along its length, said protrusions being hollow and conduit-like and protruding above said top edge and beneath said bottom edge of said at least one side connector and wherein a first protrusion is situated at a back edge of said at least one side connector is rectangular in section and has molded to its back edge a locking structure for connection to either one of said at least one side connect, said at least one back connector and said at least one hinged connector and wherein a second protrusion is situated centrally in said member closer to a front edge than said back edge of said at least one side connector and wherein a third protrusion is situated at said front edge of said at least one side connector and forms a circular socket for connection to either one of said at least one side connector, at least one back connector and at least one hinged connector.

13. The shed according to claim 12 wherein said circular socket is a short, straight wall of material running the full height of said third protrusion joined to a circular wall of material of same height as said third protrusion and wherein a portion of said circular socket distal from a back edge of said at least one side connector is formed of a hook-like structure rounded on its outer circumference at said front end of said member and wherein said hook-like structure is of a wall thickness of a second short, straight wall as its end and wherein said first short, straight wall of material faces said second short, straight wall of material to form a slot-like opening to said circular socket.

14. The shed according to claim 12 wherein said locking structure is a semi-circular trough-like shaped structure raised in a lip-like fashion from said back edge of said at least one side connector attached to said hook-like structure wherein an anterior portion of said hook-like structure forms the side of a semi-circular trough-like area and wherein at the end of said anterior portion of said hook-like structure is formed of a straight portion parallel to said back edge of said at least one side connector and wherein said straight portion runs from a back face of said member in the direction of a front face of said member and wherein said straight portion terminates in a circular disc-like structure of equal height to said hook-like structure and wherein said disc-like structure comprises a thin disc of large circumference forming the center of said disc-like structure together with an upper disc and a lower disc, both of smaller circumference, above and below said thin disc.

15. The shed according to claim 1, wherein said at least one back connector comprises a member having corners and protrusions along its length which are hollow and conduit-like and protrude above a top edge and below a bottom edge of said at least one back connector and wherein a first pair of protrusions are situated on said comers of said at least one back panel connector and protrude forward of the width of said member and wherein a second pair of protrusions are situated at edges of said at least one back panel connector inboard of said corners and a third protrusion is situated at the center of said at least one back panel connector and wherein said first pair of protrusions have attached to their front face a locking structure.

16. The shed according to claim 15 wherein said locking structure is molded in the center of a front face of each of said first pair of protrusions and wherein said locking structure is a semi-circular trough-like shaped structure raised in a lip-like fashion from said front face of said first pair of protrusions connected to a hook-like structure and wherein an anterior portion of said hook-like structure forms the side of a semi-circular trough-like area and wherein at the end of an anterior portion of said hook-like structure is formed of a straight portion parallel to said front face and wherein said straight portion is straight and level and runs from inner edges of said first protrusions towards outer edges of said first protrusions and wherein said straight portion terminates in a circular disc-like structure of equal height to trough-like shaped structure wherein said_circular disc-like structure is aligned centrally between said inner and said outer edges of said protrusions.

17. The shed according to claim 11 and wherein said roof panel of said at least one module unit is tray-like, closed on three sides having a solid surface on each of three axes and protrusions for slideably locking said roof panel to said at least one pair of side panels respectively and further comprising a roof locking and weatherproofing mechanism and wherein said protrusions are situated on two side edges of said roof panel protruding downwards and wherein a first protrusion is at a back edge of said roof panel, a second protrusion is central but towards said back edge of said roof panels and a third protrusion is at a front edge of said roof panel and wherein said roof panel has a semi-circular boss on each of two side edges of said roof panel forward of said third protrusion at a front edge of said roof panel for hingeably connecting said at least one front panel to said roof panel and wherein said roof panel is ridged.

18. The shed according to claim 17 wherein said roof locking and weatherproofing mechanism comprises a lip-like structure on said front edge of said roof panel which consists of a front surface which tapers downwards and inwards to an inward step which then becomes a gable and wherein said back edge of said roof panel has an orifice-like receptor section with a wall of material which tapers and steps downwards and outwards in an equal and opposite way to said front surface for lockably and reciprocally receiving lip-like structure of front end of said roof panel.

19. The shed according to claim 18 wherein said receptor section has a flexible upper lip and a flexible lower lip which seal a joint duly formed by a second roof panel of a second module unit and a first roof panel of a first module unit wherein said lower lip and said upper lip form clip-like structures to seal said joint.

20. A connector for connecting a plurality of panels together, said connector having a top edge and a bottom edge, said connector comprising a member having protrusions along its length, said protrusions being hollow and conduit-like and protruding above said top edge and beneath said bottom edge of said connector and wherein a first protrusion situated at a back edge of said connector is rectangular in section and has molded to its back edge a locking structure for connection to a second connector and wherein a second protrusion is situated centrally in said member closer to a front edge than said back edge of said connector and wherein a third protrusion is situated at said front edge of said connector and forms a circular socket for connection to a second connector.

21. The connector according to claim 20 and wherein said circular socket is a short, straight wall of material running the full height of said third protrusion joined to a circular wall of material of same height as said third protrusion and wherein a portion of said circular socket distal from a back edge of said connector is formed of a hook-like structure rounded on its outer circumference at said front end of said member and wherein said hook-like structure is of a wall thickness of a second short, straight wall at its and wherein said first short, straight wall of material faces said second short, straight wall of material to form a slot-like opening to said circular socket.

22. The connector according to claim 21 wherein said locking structure is a semi-circular trough-like shaped structure raised in a lip-like fashion from said back edge of said connector attached to a hook-like structure wherein an anterior portion of said hook-like structure forms the side of a semi-circular trough-like area and wherein at the end of said anterior portion of said hook-like structure is formed of a straight portion parallel to said back edge of said connector and wherein said straight portion is straight and level and runs from a back face of said member in the direction of a front face of said member and wherein said straight portion terminates in a circular disc like structure of equal height to said hook-like structure and wherein said disc like strucure is a thin disc of large circumference forming the center of said disc like structure together with an upper disc and a lower disc, both of smaller circumference, above and below said thin disc.

23. A roof panel comprising a tray-like member closed on three sides having a solid surface on each of three axes and protrusions for slideably locking said roof panel to a side panel and further comprising a roof locking and weatherproofing mechanism and wherein said protrusions are situated on each of two side edges of said roof panel protruding downwards and wherein a first protrusion is at a back edge of said roof panel, a second protrusion is central but towards said back edge of said roof panel and a third protrusion at a front edge of said panel and wherein said roof panel has a semi-circular boss on each of two side edges of said roof panel forward of said third protrusion at a front edge of said panel for hingeably connecting a second panel to said roof panel and wherein said roof pane is ridged.

24. The roof panel according to claim 23 wherein said roof locking and weatherproofing mechanism comprises a lip-like structure on said front edge of said roof panel consisting of a front surface which tapers downwards and inwards to an inward step which then becomes a gable and wherein said back edge of said roof panel has an orifice-like receptor section with a wall of material which tapers and steps downwards and outwards in an equal and opposite way to said front surface for lockably and reciprocally receiving the lip-like structure of front end of a second roof panel.

25. The roof panel according to claim 24 wherein said receptor section has a flexible upper lip and a flexible lower lip to seal a joint duly formed by said roof panel with a second roof panel wherein said lower lip and said upper lip form clip-like structures to seal said join.

* * * * *